United States Patent [19]

Mishima

[11] 4,336,736

[45] Jun. 29, 1982

[54] ELECTRONIC MUSICAL INSTRUMENT

[75] Inventor: Toshio Mishima, Kitamoto, Japan

[73] Assignee: Kabushiki Kaisha Kawai Gakki Seisakusho, Japan

[21] Appl. No.: 116,000

[22] Filed: Jan. 28, 1980

[30] Foreign Application Priority Data

| | | | |
|---|---|---|---|
| Jan. 31, 1979 | [JP] | Japan | 54-10544 |
| Jan. 31, 1979 | [JP] | Japan | 54-10545 |
| Feb. 3, 1979 | [JP] | Japan | 54-11529 |
| Feb. 5, 1979 | [JP] | Japan | 54-12025 |
| Feb. 5, 1979 | [JP] | Japan | 54-12026 |
| Mar. 17, 1979 | [JP] | Japan | 54-31410 |
| Aug. 4, 1979 | [JP] | Japan | 54-99637 |
| Nov. 8, 1979 | [JP] | Japan | 54-144816 |

[51] Int. Cl.[3] ..... G10H 1/02

[52] U.S. Cl. ..... 84/1.26; 84/1.03; 84/DIG. 12

[58] Field of Search ..... 84/1.26, DIG. 12, 1.13, 84/1.03, 1.01; 364/718

[56] References Cited

U.S. PATENT DOCUMENTS

| | | | |
|---|---|---|---|
| 3,763,364 | 10/1973 | Deutsch et al. | 84/1.03 |
| 3,952,623 | 4/1976 | Deutsch | 364/718 |
| 4,161,128 | 7/1979 | Yamada et al. | 84/1.26 |
| 4,267,763 | 5/1981 | Futamase et al. | 84/1.26 |

*Primary Examiner*—Gene Z. Rubinson
*Assistant Examiner*—Forester W. Isen
*Attorney, Agent, or Firm*—McGlew and Tuttle

[57] ABSTRACT

An electronic musical instrument in which rhythms are each subjected to digital processing and provided uniformly with out variations in volume and tone quality and respective envelope waveshapes are given different periods of attack and decay which are obtained with the same system by calculating attack and decay coefficient for the respective rhythms on a time divided bases.

7 Claims, 37 Drawing Figures

FIG. 22
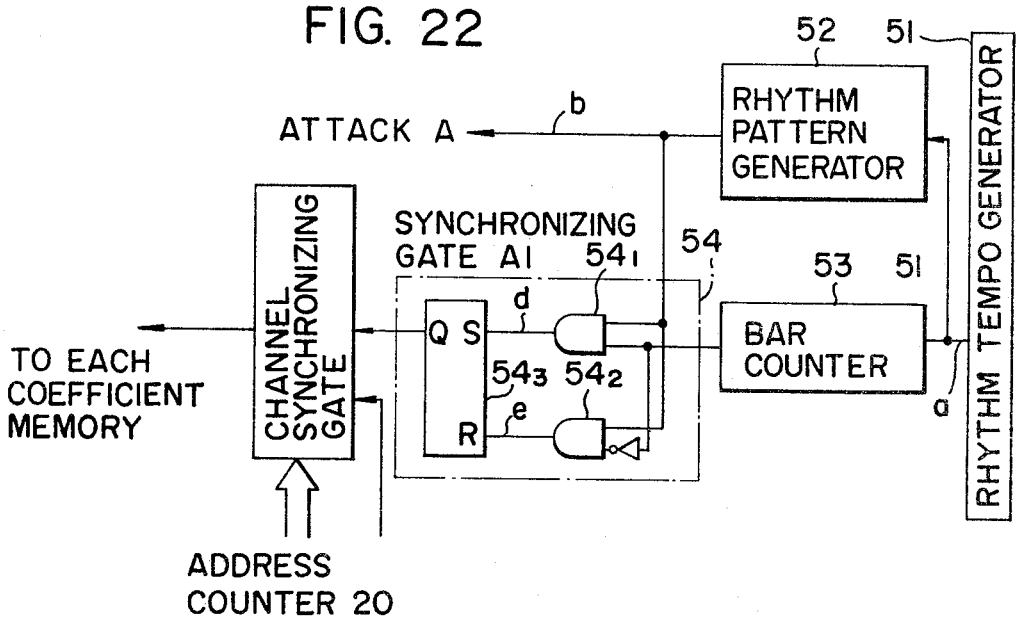
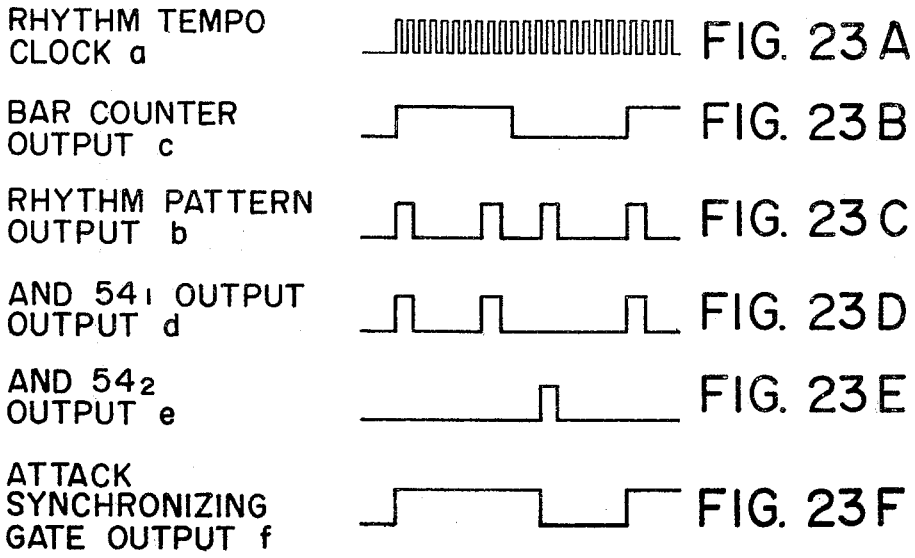

ELECTRONIC MUSICAL INSTRUMENT

BACKGROUND OF THE INVENTION

1. Field of the Invention

This invention relates to electronic musical instruments in which a desired envelope waveshape in digital form can easily be obtained through utilization of coefficients relating to attack and decay times.

2. Description of the Prior Art

Envelope signal generators for use in conventional electronic musical instruments are divided into those of an analog system that make use of the charge discharge characteristic of a time constant circuit composed of a capacitor and a resistor and those of a digital system that quantization step information is stored. In the analog system, however, various characteristics are prepared for attack, decay, sustain and release portions forming an envelope and are switched by combining many resistors, diodes and change-over switches, but this inevitably introduces complexity in circuit arrangement. In contrast thereto, the digital system has such a shortcoming that in order to increase the number of quantization steps and prepare characteristics of various attack and decay time, an enormous storage capacity is needed for storing such information.

SUMMARY OF THE INVENTION

It is an object of this invention to provide an electronic musical instrument which is adapted to obtain envelope waveshapes of various attack and decay time with a small storage capacity.

Another object of this invention is to provide an electronic musical instrument which is capable of reducing distortions due to multiplication of an envelope and a tone source frequency without increasing the number of words of the envelope waveshape which is obtained by accumulating coefficients.

Another object of this invention is to provide a rhythm generator which is capable of generating a number of tones using a small number of channels.

Another object of this invention is to provide an electronic musical instrument which is capable of changing the amplitude value of an envelope time-divided in relation to an envelope generator.

Yet another object of this invention is to provide an envelope generator which produces an envelope waveshape of sufficiently good quality with a small storage capacity.

BRIEF DESCRIPTION OF THE DRAWINGS

FIG. 22 is a detailed diagram explanatory of a broken line block 70 in FIG. 21;

FIGS. 23(a) to (f) are timing charts showing the operation of the block depicted in FIG. 22;

DESCRIPTION OF THE PREFERRED EMBODIMENTS

Figure 1:
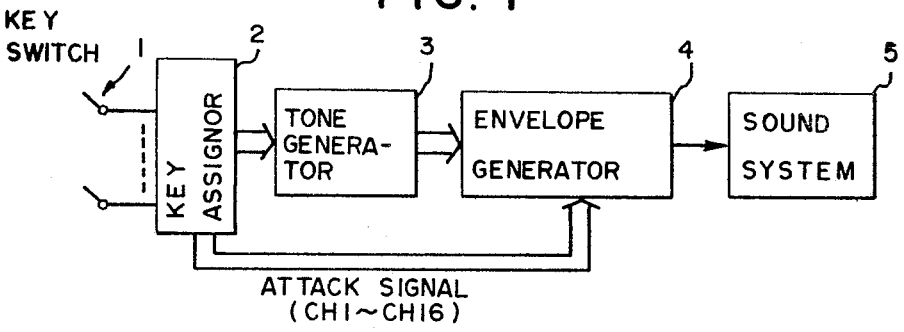
FIGS. 1 and 2 are schematic diagrams illustrating embodiments of the present invention.

The present invention will hereinafter be described in detail in connection with its embodiments. FIG. 1 schematically illustrates an embodiment of this invention as being applied to a sound generating mechanism of an electronic musical instrument. The closure of a key switch 1 is detected by a key assignor to obtain depressed key information, which is applied to a tone generator 3 to produce a tone corresponding to the key being depressed. Assuming that the key assignor is capable of detecting sixteen sounds, it provides an attack signal, i.e. a signal representing which one of channels CH1 to CH16 is assigned to the information of the key switch 1 for the storage thereof. An envelope generator 4, which is the principal part of the present invention, generates a note signal having a desired envelope waveshape formed by the tone signal from the tone generator 3 and the attack signal from the key assignor 2, and the note signal is provided to a sound system 5 which reproduces the musical note corresponding to the key depressed.

Figure 2:
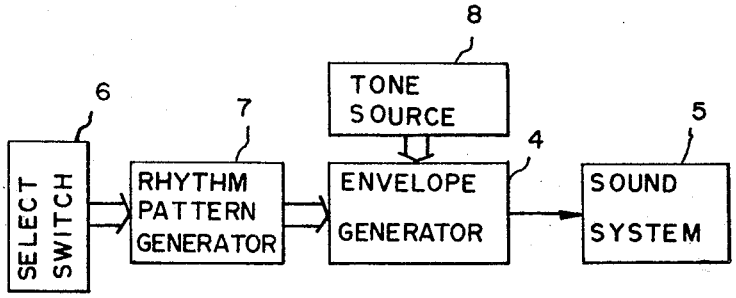

FIG. 2 schematically illustrates another embodiment of this invention as being applied to a rhythm generator. A rhythm is selected by a select switch 6, from which a rhythm pattern corresponding to the rhythm being selected is applied to a rhythm pattern generator 7. The envelope generator 4 receives a rhythm pattern signal from the rhythm pattern generator 7 and produces a desired envelope waveshape, outputting a rhythm sound of a tone source 8 corresponding to the rhythm pattern. In this case, the rhythm pattern signal corresponds to the attack signal in FIG. 1.

Figure 3:
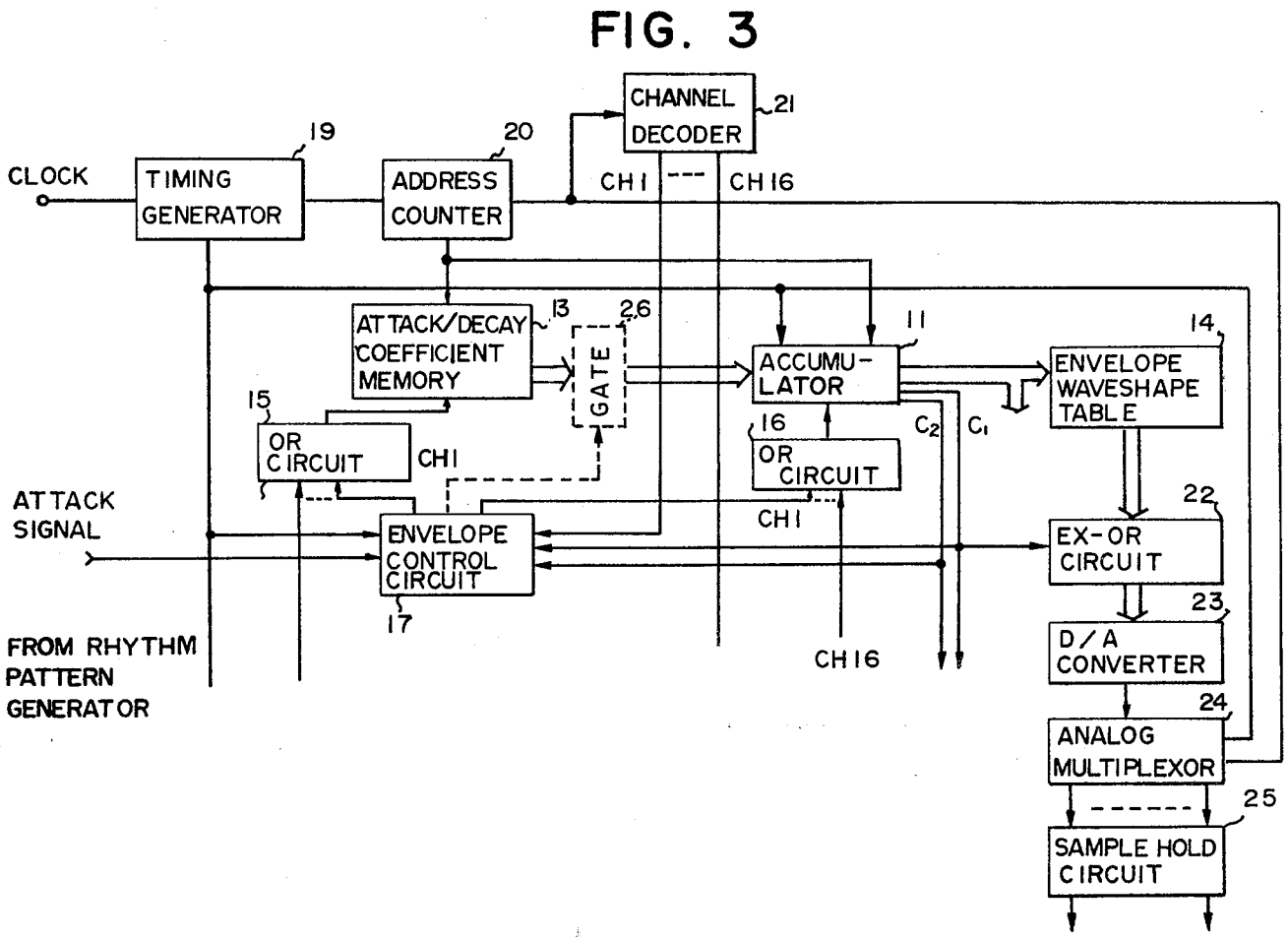
FIG. 3 is a block diagram illustrating in detail an example of an envelope generator used in the embodiment of FIG. 2.

FIG. 3 shows, by way of example, the envelope generator 4 which forms the principal part of the rhythm generator depicted in FIG. 2. Now, let it be assumed that the number of tone sources are sixteen, that sixteen channels are provided correspondingly and that the formation of the envelope waveshape is carried out on a time shared basis.

In FIG. 3, a rhythm pattern signal (hereinafter referred to as an attack signal) from the rhythm pattern generator is applied to an envelope control circuit 17, wherein timings of attack and decay of an envelope waveshape are formed by signals C1 and C2 described later. Further, a channel assignment signal from a channel decoder 21 which is assigned via an address counter 20 driven by a timing generator 19 is provided to the envelope control circuit 17, from which an address signal thus assigned is supplied via an OR circuit 15 to an attack/decay coefficient memory 13. From the attack/decay coefficient memory 13 are read by an address from the address counter 20 addition coefficients of attack and decay, described later, which are via a gate 26 or directly (in the absence of the gate 26 indicated by the broken line) to an accumulator 11 which comprises an adder, a gate circuit, a register and a memory (RAM). The gate 26 is indicated by the broken line for the reason that the gate 26 may be absent. (The resulting waveform differs in dependence on whether the gate is provided or not, as described later (FIGS. 5 and 6)).

Supplied with an address from the address counter 20 and a channel assignment signal via an OR circuit 16 from the envelope control circuit 17, the accumulator 11 accumulates the addition coefficients by a method described later to provide 8-bit binary address information as an accumulated output signal to an envelope waveshape table 14. The processed data by the accumulator 11 is 10-bit, including carry signals C1 and C2 in addition to the above-said 8-bit address data. In the case of the 8-bit address data being applied to the envelope waveshape table 14, five high-order bits are used as the address, with the three low-order bits discarded. The signal C1 indicates the completion of an attack period and the signal C2 the completion of decay, the both signals being applied to the envelope control circuit 17. In the accumulator 11 there are obtained accumulated output signals of sixteen envelope waveshapes corresponding to the sixteen channels.

An envelope time T between the rise and fall of the envelope accumulated by attack and decay coefficients stored in the attack/decay coefficient memory 13 is given by the following expression:

$$T = \frac{N \times W}{\frac{C_L}{n} \times Aad}$$

where N is the number of channels, W is the number of words, Aad is an envelope addition coefficient, $C_L$ is a clock frequency and n is a frequency divided timing. In the present embodiment, in the case where N=16, W=32 and n=4, it follows that $$T=(512\times 4)/C_L\times Aad)$$

If $C_L$ =10 KHz, it follows that when Aad=1/23, T=1.64 sec. and that when Aad=1, T=0.20 sec. In this way, the attack and the decay time are determined by the envelope addition coefficient Aad. The attack/decay coefficient memory 13 stores the addition coefficients Aad of attack and decay corresponding to the sixteen tone sources.

Table 1 shows, by way of example, the accumulation time T (sec.) of the coefficient Aad of each of attack and decay.

TABLE 1

| Aad | 1/8 | 1/4 | 1/2 | 1 | 2 | 4 | 8 | 16 | ($C_L$ = 10 KHz) T(sec) |
|---|---|---|---|---|---|---|---|---|---|
| Attack | 1 | 1 | 0 | 0 | 0 | 1 | 0 | 1 | 0.01 |
| Decay | 0 | 1 | 0 | 0 | 0 | 0 | 0 | 0 | 0.82 |

The envelope waveshape table 14 has stored therein a 32-word envelope waveshape which uses the 5-bit accumulated output signal as an address. Table 2 shows an example of the stored content of the envelope waveshape table 14.

TABLE 2

| Word | Bit | Binary code MSB | Binary code SLB | Word | Bit | Binary code MSB | Binary code LSB |
|---|---|---|---|---|---|---|---|
| 1 | 0 | 0000 | 0000 | 17 | 241 | 1111 | 0001 |
| 2 | 42 | 0010 | 1010 | 18 | 244 | 1111 | 0100 |
| 3 | 77 | 0100 | 1101 | 19 | 246 | 1111 | 0110 |
| 4 | 106 | 0110 | 1010 | 20 | 247 | 1111 | 0111 |
| 5 | 131 | 1000 | 0011 | 21 | 249 | 1111 | 1001 |
| 6 | 151 | 1001 | 0111 | 22 | 250 | 1111 | 1010 |
| 7 | 168 | 1010 | 1000 | 23 | 251 | 1111 | 1011 |
| 8 | 183 | 1011 | 0111 | 24 | 252 | 1111 | 1100 |
| 9 | 195 | 1100 | 0011 | 25 | 253 | 1111 | 1101 |
| 10 | 205 | 1100 | 1101 | 26 | 253 | 1111 | 1101 |
| 11 | 213 | 1101 | 0101 | 27 | 254 | 1111 | 1110 |
| 12 | 220 | 1101 | 1100 | 28 | 254 | 1111 | 1110 |
| 13 | 226 | 1110 | 0010 | 29 | 254 | 1111 | 1110 |
| 14 | 231 | 1110 | 0111 | 30 | 255 | 1111 | 1111 |
| 15 | 235 | 1110 | 1011 | 31 | 255 | 1111 | 1111 |
| 16 | 239 | 1110 | 1111 | 32 | 255 | 1111 | 1111 |

Figure 4:
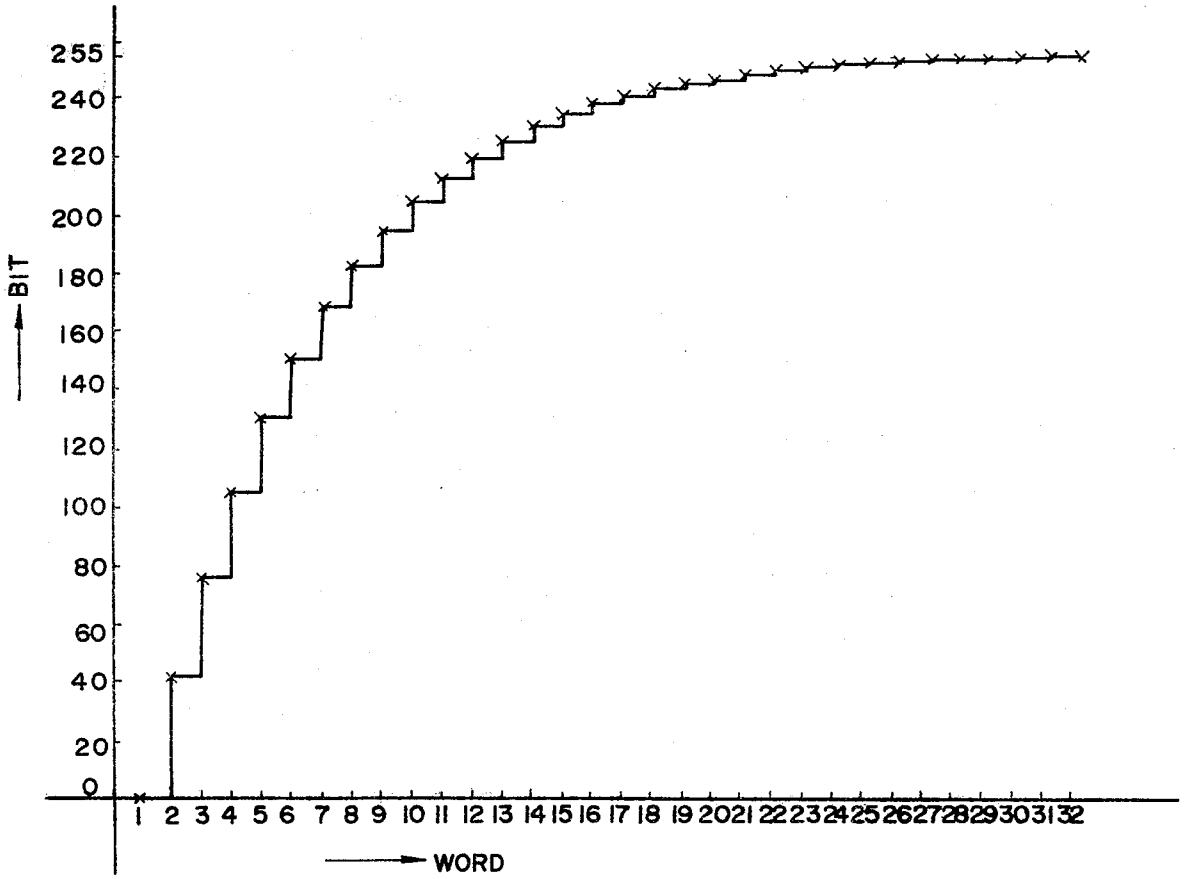
FIGS. 4, 5(a) to (c) and 6(a) to (d) are waveform diagrams explanatory of the principles of the present invention.

This value is obtained by the following expression. Where the envelope waveshape table 14 is a 32-word, 8-bit fixed memory (ROM), $$Y=256-256^{(31-W/31}$$

where Y is the number of bits and W is the number of words (0 to 31). This waveshape is shown in FIG. 4 and is used in common to both attack and decay waveshapes. In the above, the waveshape is described to be 32-word which uses, as an address, five high-order bits of the output signal from the accumulator 11; but, by using six or more bits, the number of quantization steps can be increased.

Next, the content of the envelope waveshape table 14 is applied to an exclusive (EX)-OR circuit 22, wherein after completion of the 32-word attack waveshape by the signal C1, if the signal C1 is higher in level than an initial value of the next cycle, the data from the envelope waveshape table 14 is inverted to form a decay waveshape. FIG. 5(a) shows the inversion of the attack waveshape to the decay one; the signal C1 in FIG. 5(b) indicates the end of attack and the signal C2 in FIG. 5(c) the end of decay.

The waveshapes in FIGS. 5(a), (b) and (c) are those in the case where the gate 26 is not provided in the embodiment of FIG. 3. In the case where the gate 26 is provided, however, the waveshape is not immediately switched by the signal C1 from attack to decay but is put in a hold state by the control of the gate 26 (the waveshapes in this case being shown in FIGS. 6(a) to (c)), thereafter being switched to decay by the fall of the attack signal. This is shown in FIG. 6(a) and the relationships of the external signals are shown in FIGS. 6(b) and (c). In this case, the same content of the envelope waveshape table 14 is used as a waveshape common to both of attack and decay. Next, the output from the EX-OR circuit 22 is applied to a D-A converter 23 for conversion into an analog quantity, which is provided to an analog multiplexor 24, wherein it is time-divided. The analog data thus time-divided is assigned for each channel, and analog data which is 1/16 of the unit time is held by a sample hold circuit 25.

Figure 7A:
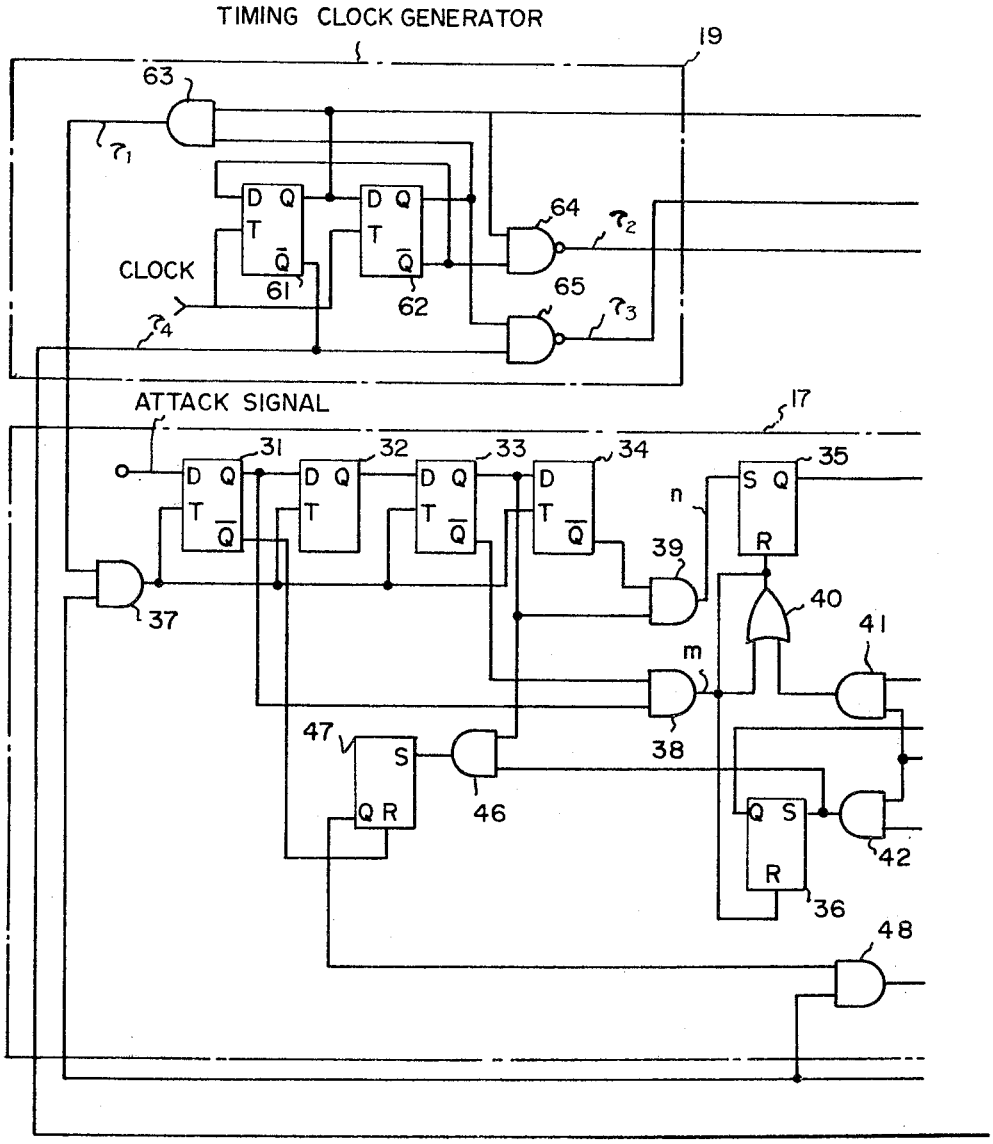
FIGS. 7A and B show in detail the envelope generator depicted in FIG. 3.
Figure 7B:
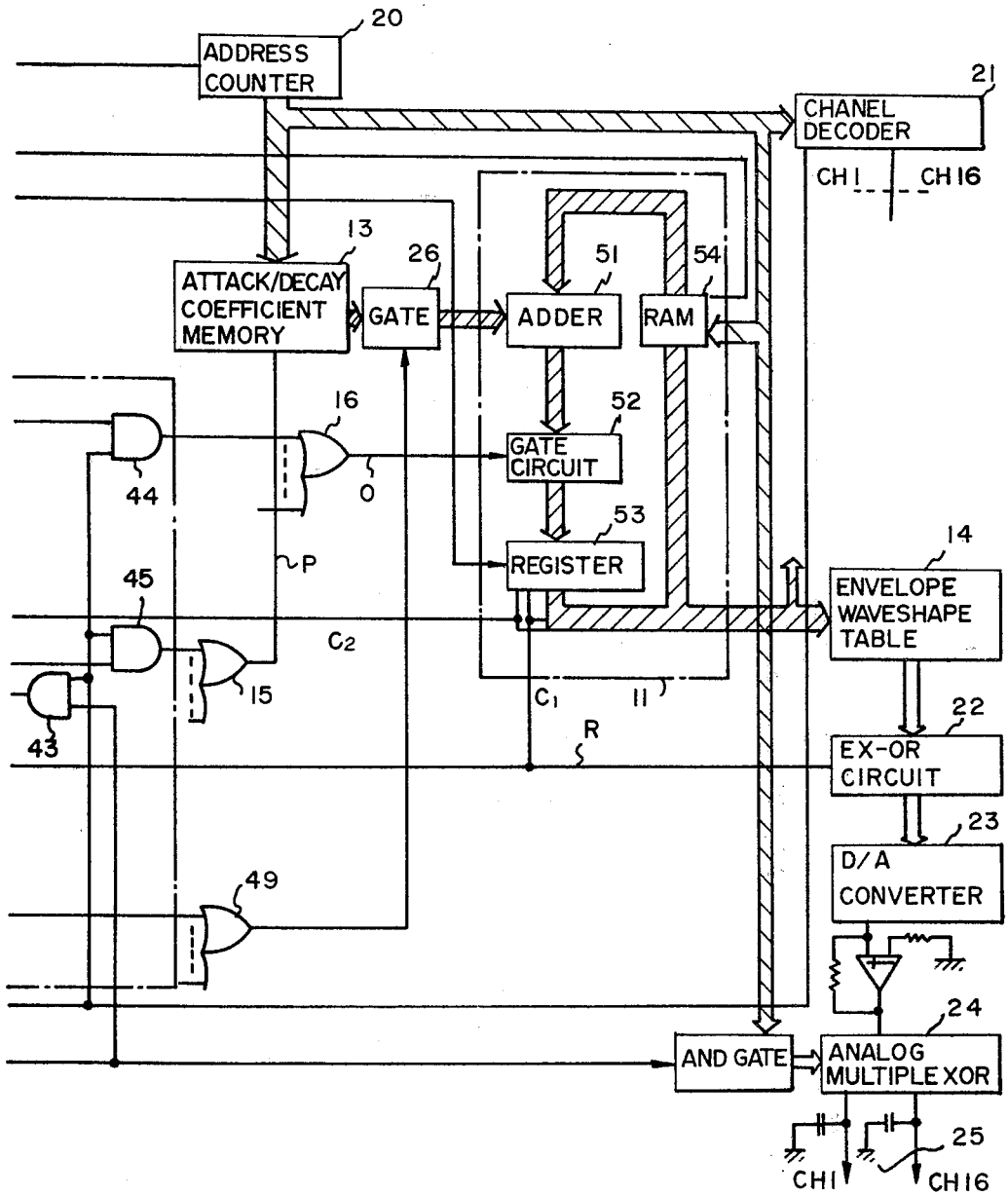
Figure 8:
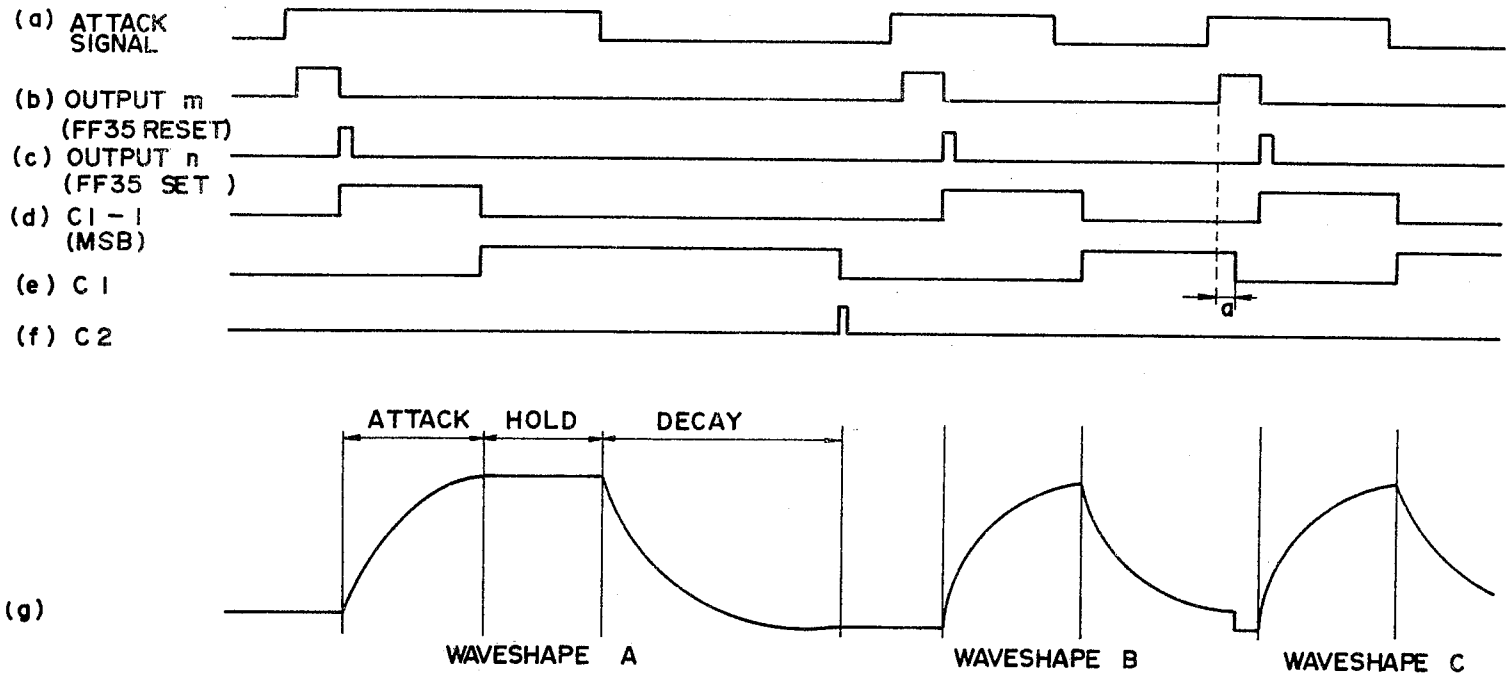
FIGS. 8(a) to (g) are timing charts showing the operation of an envelope control circuit utilized in FIG. 7.

FIGS. 7A and 7B illustrate in detail an example of the circuit arrangement of the embodiment shown in FIG. 3, and FIG. 8 shows waveforms of the operation of its principal part. A description will be given, with reference to FIG. 8, of the outline of the circuit arrangement of FIG. 7 (in which the gate 26 is provided) and the operation of its principal part.

In FIG. 7, a timing clock generator 19 is supplied with a clock pulse at a T terminal of each of D flip-flops 61 and 62 connected in cascade and, by a combination of their Q and $\overline{Q}$ outputs, produces various timing clock pulses, that is, $\tau_1$ which is applied via an AND circuit 63 to a clock terminal of a flip-flop in the envelope control circuit 17, $\tau_2$ and $\tau_3$ for read control use which are respectively applied via AND circuits 64 and 65 to a register 53 and a RAM 54 in the accumulator 11, and $\tau_4$ which is applied to the envelope control circuit 17 and the analog multiplexor 24.

In the envelope control circuit 17, the attack signal is provided to a D terminal of a first-stage one 31 of cascade-connected D flip-flops 31, 32, 33 and 34, and the timing clock pulse $\tau_1$ is applied via an AND circuit 37 to a T terminal of each of the D flip-flops in synchronism with a channel time-sharing signal derived from the channel decoder 21.

The flip-flops 31 to 34 constitute a delay circuit for initial setting. A Q output from the flip-flop 31 and a $\overline{Q}$ output from the flip-flop 33 are applied to an AND circuit 38, whose output is provided via an OR circuit 40 to an R terminal of a flip-flop 35, whereas a Q output from the flip-flop 33 and a $\overline{Q}$ output from the flip-flop 34 are provided via an AND circuit 39 to an S terminal of the flip-flop 35. Its Q output is applied via a channel-synchronized AND circuit 44 and the OR circuit 16 to a gate circuit 52 of the accumulator 11, turning ON the gate circuit 52.

In the meantime, the carry signals C1 and C2 for determining the attack and the decay time are supplied from a register 53 of the accumulator 11 to the envelope control circuit 17. The signal C1 is applied to AND circuits 43 and 42 to perform timing control and channel synchronization, and the signal is provided to an S terminal of a flip-flop 36, whose Q output is supplied to an AND circuit 45 to perform channel synchronization. The output from the AND circuit 45 is provided via the OR circuit 15 to the attack/decay coefficient memory 13 to switch the attack coefficient to the decay coefficient. The flip-flop 36 is reset together with the flip-flop 35.

At the same time, the signal C1 from the AND circuit 42 of the envelope control circuit 17 is branched and applied via an AND circuit 46 to an S terminal of a flip-flop 47 together with the attack signal from the Q ouptut of the flip-flop 33. A Q output from the flip-flop 47 is provided to an AND circuit 48 to perform channel synchronization, and the output from the AND circuit 48 is supplied via an OR circuit 49 to the gate 26 connected between the attack/decay coefficient memory 13 and an adder 51, controlling the gate 26 to turn it ON and OFF.

The signal C1 is applied to the AND circuits 43 and 41 to carry out timing control and channel synchronization, and the output from the AND circuit 41 is provided via the OR circuit 40 to the R terminal of the flip-flop 35 to reset it, turning OFF the gate circuit 52 of the accumulator 11.

FIGS. (8(a) to (g) are timing charts showing the operations of the principal part of the envelope control circuit 17 depicted in FIG. 7. As described above, upon application of the attack signal of FIG. 8(a) to the envelope control circuit 17, the output m from the AND circuit 38 yields a waveform of FIG. 8(b), resetting the flip-flop 35. Next, in one cycle, the output n from the AND circuit 39 produces such a set pulse as shown in FIG. 8(c), setting the flip-flop 35, the content of the channel CH1 of the accumulator 11 is cleared, and upon occurrence of the next set pulse, the Q output from the flip-flop 35 and accordingly the output O from the OR circuit 16 assumes a level "H", turning ON the gate circuit 52 of the accumulator 11. Thus, the accumulator 11 starts accumulation. A description will be made of the operations of the signals C1 and C2 in connection with a detailed circuit arrangement of the accumulator 11.

The accumulator 11 comprises the adder 51, the gate circuit 52, the register 53 and a memory (RAM) 54 connected in a loop. By the address signal from the address counter 20, an attack coefficient corresponding to the address signal is read from the attack/decay coefficient memory 13 to the adder 51. The output data from the adder 51 passes through the gate circuit 52, opened by the level "H" of the output O from the OR circuit 16, and by controlling the register 53 and the RAM 54 by the timing clock pulses $\tau_2$ and $\tau_3$, the abovesaid output data circulates in the loop, by which accumulation, for example, corresponding to FIG. 4 is carried out. The end of the calculation for attack is detected by a carry of the signal C1. Attack ends with the most significant bit in the accumulation for attack, that is, a bit C1-1 immediately preceding the signal C1, such as shown in FIG. 8(d), generating a carry of the signal C1 in the register 53, as depicted in FIG. 8(e). The signal C1 and the attack signal are applied via the AND circuit 46, the flip-flop 47, the AND circuit 48 and the OR circuit 49 to the gate 26 to turn it OFF, by which the coefficient input to the accumulator 11 becomes "0", so that the envelope waveshape is put in the hold state. Next, upon fall of the attack signal of FIG. 8(a), the gate 26 is turned ON, permitting the envelope waveshape to decay. In other words, the output P from the OR circuit 15 is applied to the attack/decay coefficient memory 13 to switch the attack coefficient to the decay one. At the same time, the signal C1 applies an output R to the EX-OR circuit 22 to invert the output signal from the envelope waveshape table 14 to form a decay waveshape. Upon completion of delay, a carry of the signal C2 in the register 53 occurs, as shown in FIG. 8(f), to reset the flip-flop 35, stopping the accumulation by the output O from the OR circuit 16 to obtain an envelope waveshape A shown in FIG. 8(g). If an attack input occurs again in the course of attack or decay, then the flip-flop 35 is reset to clear the accumulator 11, re-starting the accumulation.

The envelope waveshape A is produced in the case where the attack time is shorter than the attack signal width, as described above, and in this case, the waveshape is composed of attack, hold and decay. In contrast thereto, an envelope waveshape B is obtained in the case where the attack time is longer than the attack signal width; in this case, no hold state exists and the attack waveshape is immediately followed by the decay waveshape. An envelope waveshape C is obtained in the case where the attack signal is inputted before termination of the decay waveshape; in this case, the flip-flop 35 is reset to turn OFF the gate of the accumulator 11, reducing the content of the accumulator 11 to "0". The reason for which the content "0" of the accumulator 11 lags the reset signal of the flip-flop 35 by a time a indicated by the arrow is that the content of the RAM of the accumulator 11 becomes "0" after scanning of sixteen channels. Thereafter, the flip-flop 35 is set to start attack. Five high-order bits of the accumulation result, excepting the signals C1 and C2, are applied as an address corresponding to the aforementioned thirty-two words to the envelope waveshape table (ROM) 14, and the other three low-order bits are discarded. The envelope waveshape data is provided to the EX-OR circuit 22, wherein it is inverted in decay, as described above, and then converted by the D-A converter into an analog quantity.

Up to this stage, the data is a time-divided signal, and hence must be divided for each channel. The analog multiplexor 24 including an AND gate assigns, on the basis of channel addresses, the time-shared signal to the channels CH1 to CH16 using the timing clock pulse $\tau_4$. The analog data thus assigned is held by the sample hold circuit 25 and made DC.

Figure 9:
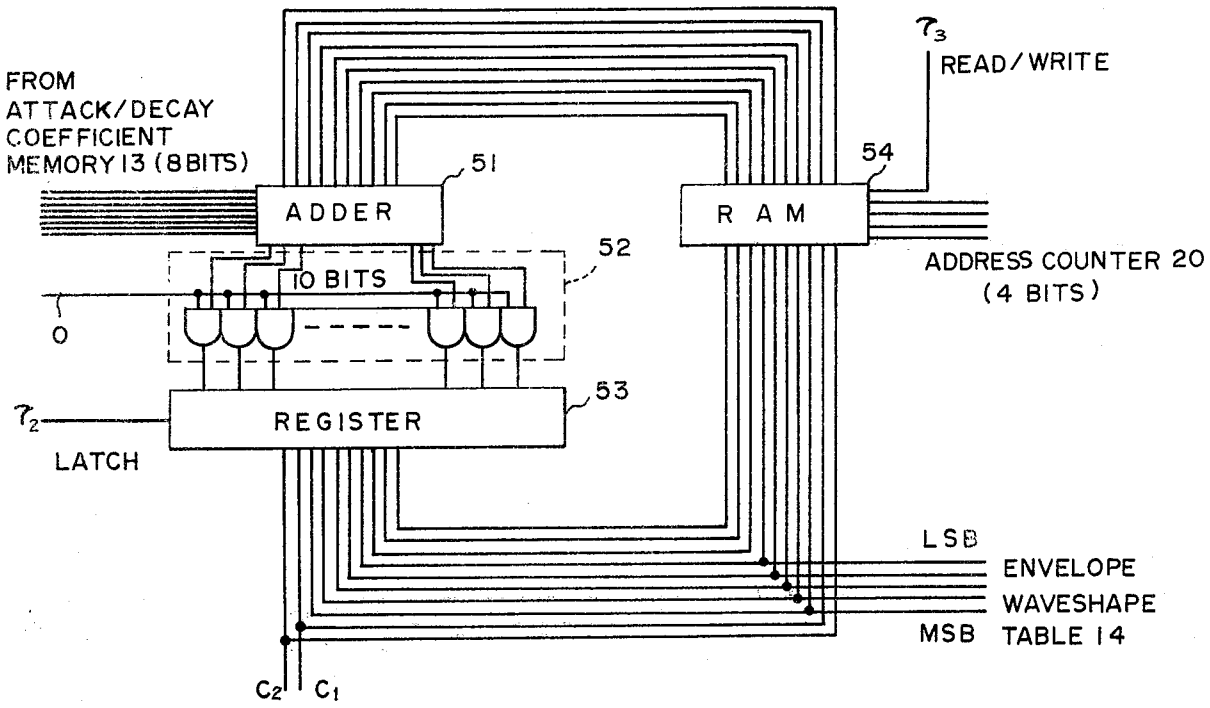
FIG. 9 is a diagram showing in detail an accumulator employed in FIG. 7.

FIG. 9 illustrates in detail an example of the circuit arrangement of the accumulator 11 utilized in FIG. 7. In FIG. 9, values read from the attack/decay coefficient memory 13 are added together by the adder 51, and when the ouput O from the OR circuit 16 in FIG. 7 which is one input to the gate circuit 52 has the level "H", the 10-bit data of the adder 51 is stored by the timing clock pulse $\tau_2$ in the register 53. Then, the register output is written by the timing clock pulse $\tau_3$ in the RAM 54 of 16 words $\times$ 10 bits. Upon completion of the write, the address counter 20 advances by one step, performing the calculation for the next channel in the same manner as described above. At this time, the immediately preceding value of the RAM 54 is inputted to the adder 51, wherein it is added again to the coefficient read from the attack/decay coefficient memory 13. And the same operations as those in the abovesaid cycle are repeated, and the accumulation result is stored in the RAM 54. As address information for the envelope waveshape table 14, use is made of five bits, excepting the signals C1 and C2 and the three low-order bits from the ten bits, as described previously. That is, the five bits are employed as an address for the thirty-two words of the envelope waveshape table 14.

As described above, according to the present invention, the coefficients relating to the attack and the decay time are prestored in an attack/decay coefficient memory, and based on the coefficients, attack and decay are respectively accumulated by an accumulator. By an attack signal from the outside, the accumulation of the accumulator is started, and by an attack end signal, read of the coefficient from the attack/decay coefficient memory is cut off and the accumulated value of the accumulator is held. Then, by the fall of the attack signal, attack is switched to decay, and at the same time, the output signal from an envelope waveshape memory is inverted and the accumulation of the accumulator is stopped by a decay end signal.

With such arrangement, as exemplified in Tables 1 and 2, attack, hold and decay waveshapes or attack and decay waveshapes of arbitrary durations can be obtained using the coefficients Aad relating to the attack and the decay time. The envelope waveshape memory has stored therein the attack waveshape and, in the decay, the waveshape is inverted, so that a number of envelope waveshapes are available with a small storage capacity. By increasing the number of words used, the quantization step can be made sufficiently close; this permits substantial simplification of the arrangement of the envelope generator as compared with a conventional envelope generator using charge and discharge of a time constant circuit of an analog system, and on top of that, envelope waveshapes of good quality can be obtained. As seen from FIG. 6, the circuit arrangement is suitable for fabrication as a large scale integrated circuit, so that a substantial reduction of the manufacturing cost can be expected.

The foregoing embodiment of the present invention has been described as being applied to a rhythm generator, but it is apparent that the invention is applicable to the sound generating mechanism of a digital organ, shown in FIG. 1. In this case, since the key assignor can be employed, the number of gate circuits which must be provided for all keys in the prior art can be reduced to the number of sounds to be produced; this also permits simplification of the circuit arrangement and facilitates incorporation as a large scale integrated circuit.

Figure 10:
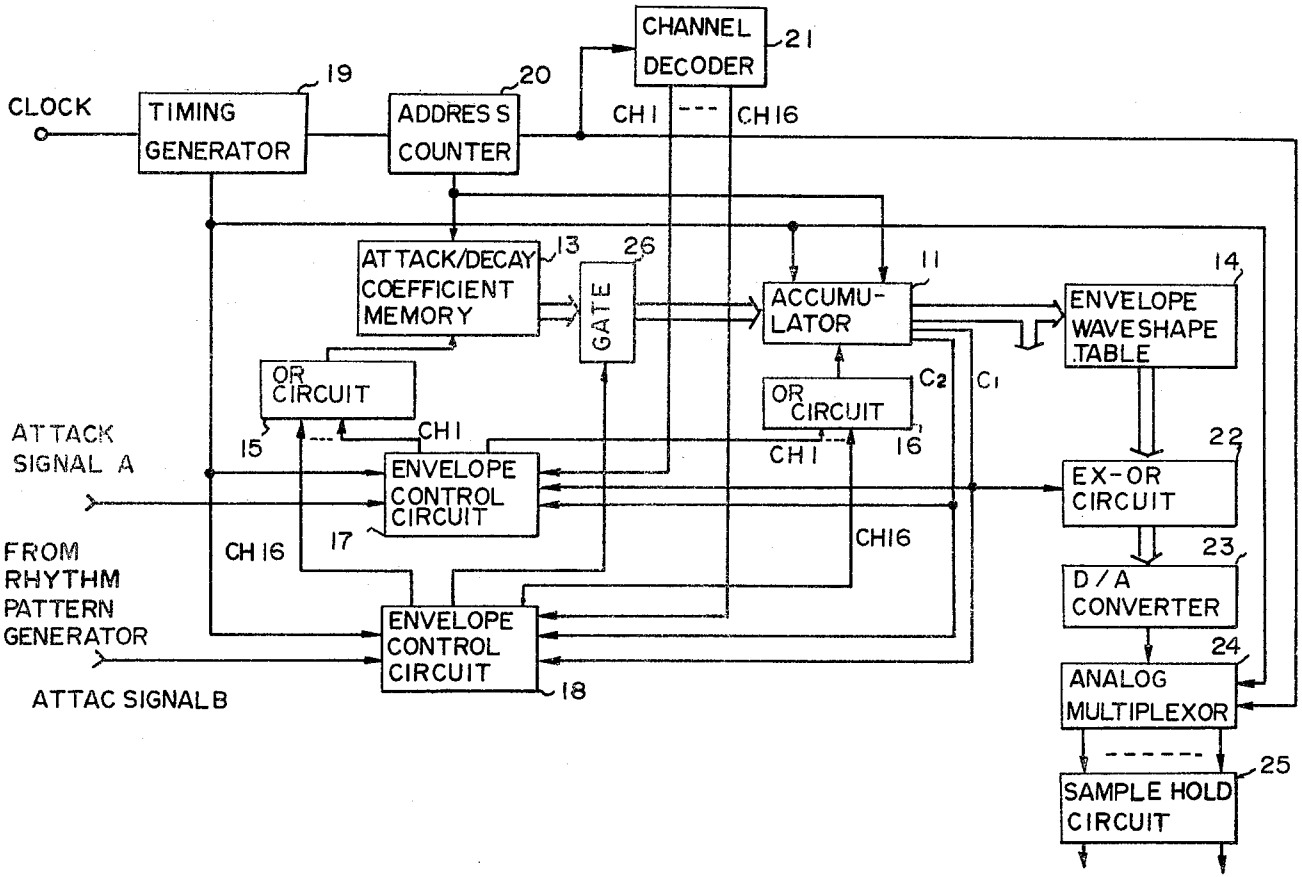
FIG. 10 is a block diagram illustrating in detail another example of the envelope generator.

FIG. 10 illustrates another embodiment of the envelope generator 4 used in FIG. 2. This envelope generator differs from that shown in FIG. 3 in that an envelope control circuit 18 is provided. Of two kinds of rhythm pattern signals (attack signals) A and B derived from the rhythm pattern generator 7 (see FIG. 2), the attack signal A is applied to the envelope control circuit 17, whereas the attack signal B is applied to the envelope control circuit 18. The envelope control circuit 18 generates timings for attack and decay of an envelope waveshape by the signals C1 and C2, as is the case with the envelope control circuit 17. A channel assignment signal (CH16) from the channel decoder 21 is provided to the envelope control circuit 18, from which an assigned address signal is supplied via the OR circuit 15 to the attack/decay coefficient memory 13. In this case, upon generation of the attack end signal C1 from the accumulator, a control signal provided via the envelope control circuit 18 becomes high in level, by which the gate 26 is turned OFF to cut off the supply of the coefficient from the attack/decay coefficient memory 13 to the accumulator 11. As a consequence, the accumulator 11 adds "0" and holds the same value and continues to output it. In other words, the envelope control circuits 17 and 18 differ in the ON-OFF state of the gate 26 at the moment of generation of the attack end signal C1 from the accumulator 11, by which an envelope without the hold state or an envelope with the hold state is selected. In the present embodiment, these two waveshapes are included in assigned channels.

Figure 5:
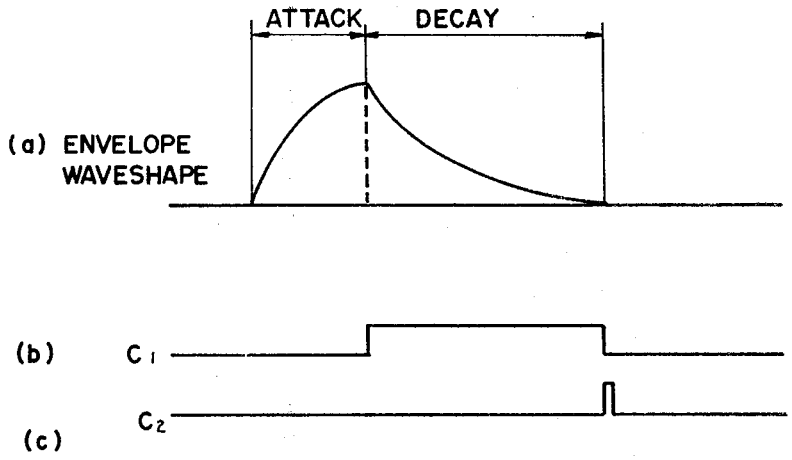
Figure 6:
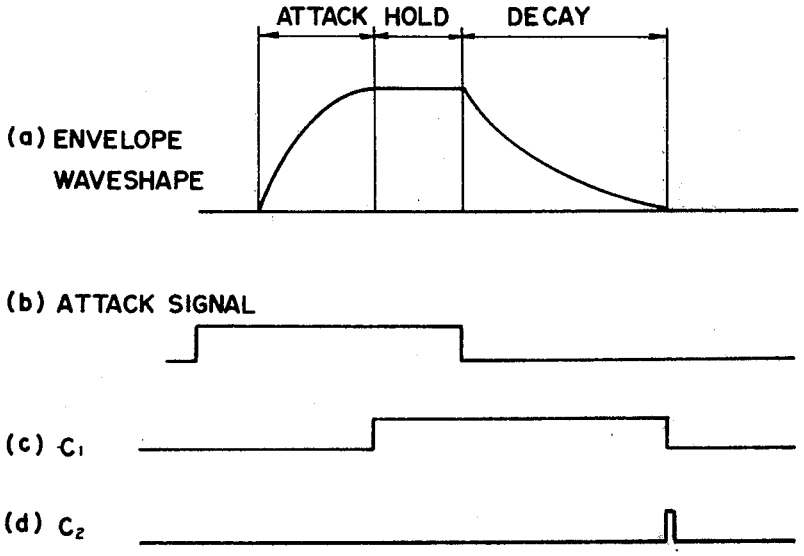

In this embodiment, the operations by the envelope control circuits 17 and 18 are the same as those described previously with regard to FIGS. 3, 5 and 6; attack and decay waveshapes related to the control of the envelope control circuit 17 are the same as those shown in FIG. 5(a); and a waveshape having attack, hold and decay is the same as that shown in FIG. 6(a). Therefore, operations of the other parts are identical with those described in the foregoing, and hence no detailed description will not be repeated.

Figure 11:
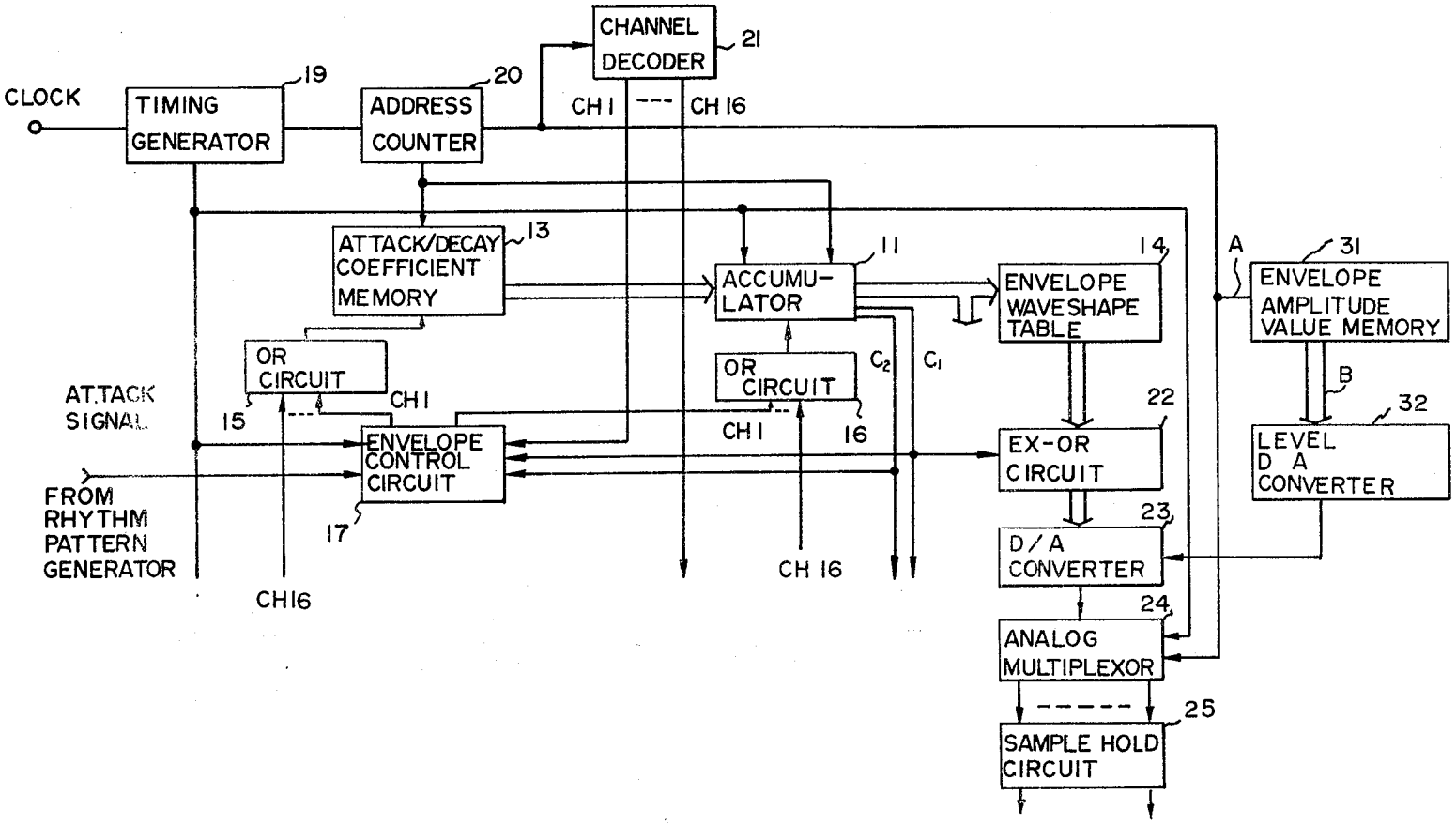
FIG. 11 is a block diagram illustrating in detail another example of the envelope generator.

FIG. 11 illustrates another embodiment of the present invention, in which an envelope amplitude value memory 31 and a level D-A converter 32 are added to the envelope generator shown in FIG. 3.

In this embodiment, in order that the amplitude value of the envelope for each channel may be changed, there are additionally provided the envelope amplitude value memory 3 from which is read the envelope amplitude value by an address A from the address counter 20 and the level D-A converter 32 which converts the read amplitude value data B to analog form. The time-divided analog data C from the D-A converter 32 is applied to the D-A converter 23 of the envelope generator, wherein it is multiplied by the corresponding time-divided envelope waveshape to obtain a level-changed output D.

Figure 12:
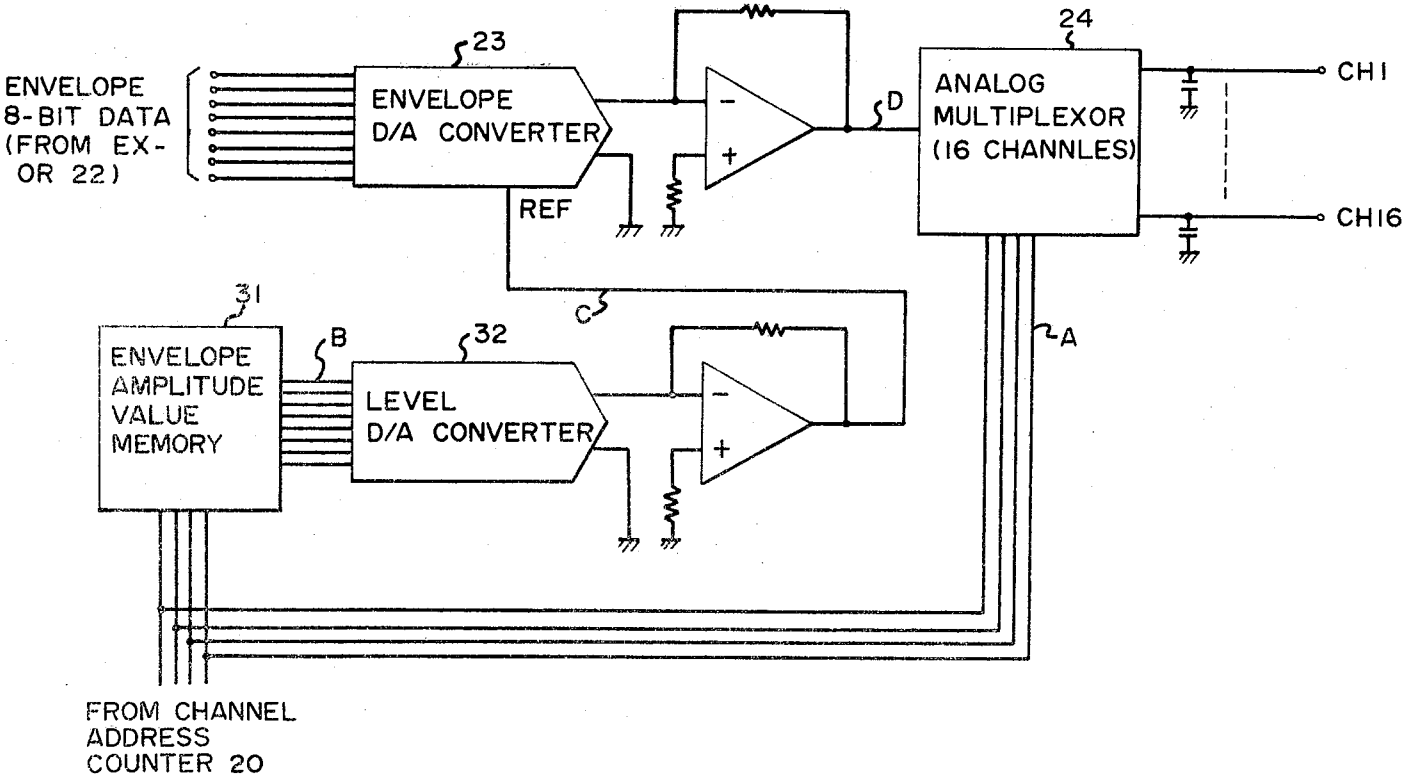
FIG. 12 is an explanatory diagram of the example of the envelope generator shown in FIG. 11.

FIG. 12 is a detailed explanatory diagram of the embodiment shown in FIG. 11. In FIG. 12, 8-bit data of the envelope waveshape from the EX-OR circuit 22 is converted by the envelope D-A converter 23 into analog data, which is provided via an operational amplifier to the 16-channel analog multiplexor 24, wherein it is assigned to the respective channels CH1 to CH16, as described above with respect to FIG. 11. The present embodiment employs, as the envelope D-A converter 23, a multiplying type D-A converter, wherein the 8-bit data input from the EX-OR circuit 22 is multiplied by level information (a coefficient) from a terminal REF (reference) corresponding to each channel, thereby to introduce a level change in the analog output.

To provide the level information, 8-bit level information corresponding to the respective channels is stored in the envelope amplitude value memory 31 and read therefrom by the address A from the (channel) address counter 20 in FIG. 11. This address is provided by branching the address which is applied to the analog multiplexor 24. The level information B derived from the envelope amplitude memory 31 is converted by the level D-A converter 32 to an analog signal, which is provided to an operational amplifier, and the analog level information C therefrom is applied to the terminal REF of the envelope D-A converter 23 for multiplication of the envelope waveshape data for each channel. For example, the time-divided envelope waveshape data of the first channel CH1 in the envelope D-A converter 23 is multiplied by the level information of an address 1 from the envelope amplitude value memory 31, and then the envelope waveshape data of the secon channel CH2 is multiplied by the level information of an address 2; in this way, the same operation is performed for each channel, thereby to change the level of the output signal.

In the present embodiment, since the 8-bit level information is stored in the envelope amplitude value memory 31, maximum data is "11111111", which is 255 in the decimal notation. Accordingly, one step is 1/255, and the level ratio R is given by the following expression:

$$R = 20 \log (X/255)$$

where X is the number of steps ($0 \leqq X \leqq 255$). Assuming that the maximum value of the level is 0 dB, in the case of one step down, X=254 and R=0.034 dB. In order to lower the level by 3 dB, the number of steps X used is 181 since R=−3dB.

As described above, according to the present embodiment, the envelope waveshape for each channel is outputted from the envelope generator in FIG. 3 on a time shared basis; a desired envelope amplitude value for each channel is stored in an envelope amplitude value memory; the envelope amplitude value is converted by a D-A converter to an analog quantity; and the envelope waveshape is applied to a multiplying type D-A converter for conversion into an analog quantity corresponding to the output signal from the D-A converter. As a result, an envelope waveshape having its amplitude value changed is obtained for each channel, thus making it possible to produce varied, tasteful musical notes, as compared with those obtainable with the prior art in which envelope waveshapes in all channels are of the same level.

Figure 13A:
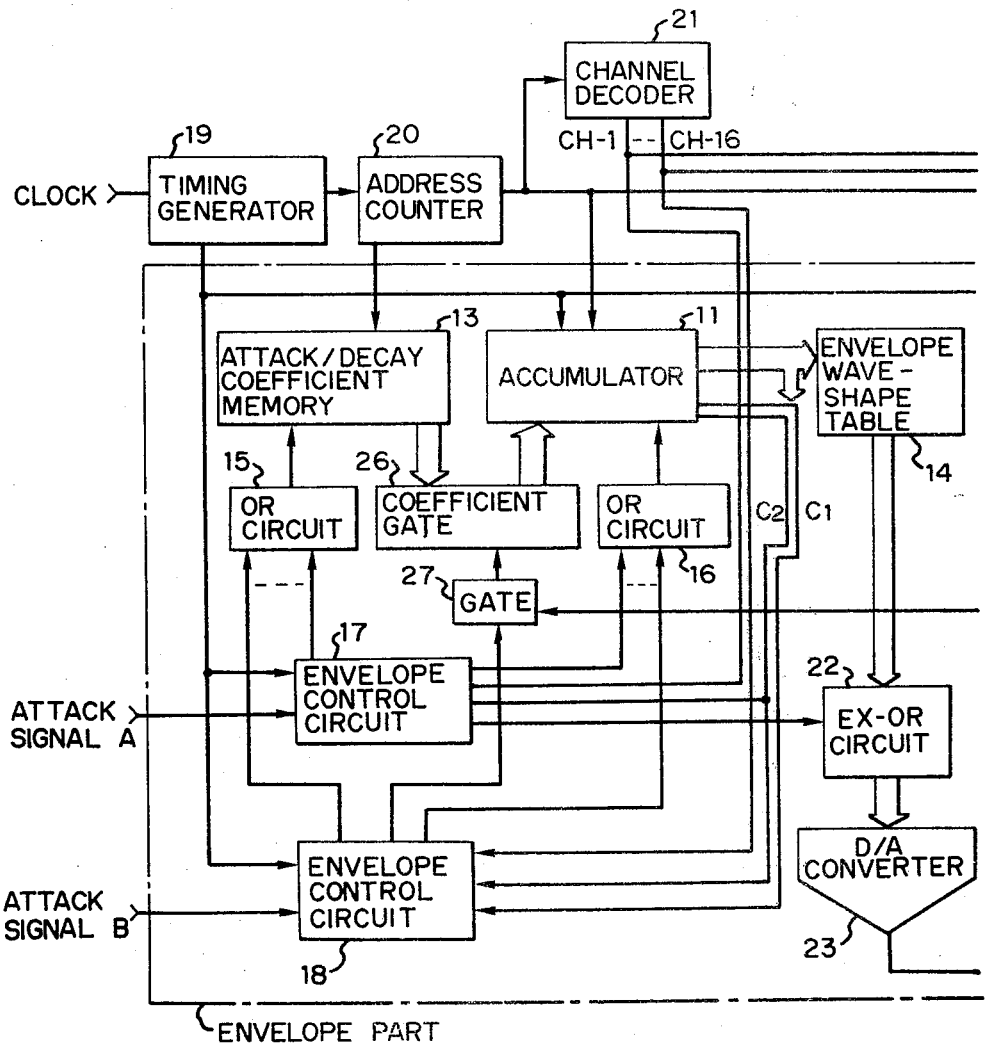
FIGS. 13A and B illustrate in block form another embodiment of the present invention.

FIGS. 13A and B illustrate in block form another embodiment of this invention, in which in the case of obtaining an envelope waveshape by accumulating coefficients relating to the envelope time, the accumulation is timed at the zero cross point of the tone source frequency, thereby to reduce distortions due to multiplication. The present embodiment shows an improvement of the envelope generator depicted in FIG. 10. In the example of FIG. 10, the coefficients relating to the attack and the decay time are prestored in a memory and accumulated by an accumulator, and an envelope waveshape is read from an envelope waveshape memory using the accumulated output signal as an address; and the attack and the decay waveshape are common to each other, and the decay waveshape is formed by inverting the envelope waveshape. By this method, envelope waveshapes of various attack and decay times can be obtained with a small storage capacity. Furthermore, by providing a gate for controlling the timing of decay for providing the hold time, a waveshape having attack, hold and decay can also be obtained.

Figure 14:
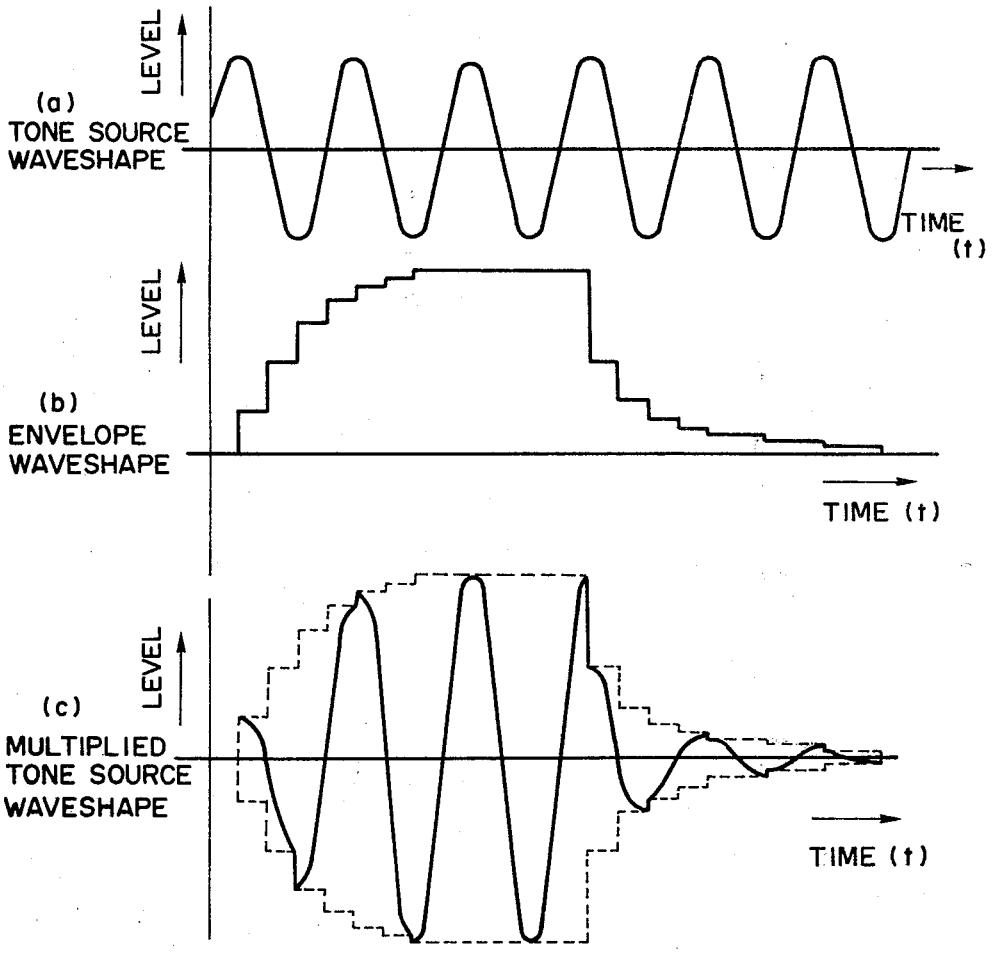
FIGS. 14(a) to (c) are diagram explanatory of the principles for multiplying an envelope waveshape produced in digital form and a tone source frequency.

In the case where the envelope waveshape thus produced in digital form is multiplied by a certain tone source frequency, the timing for the accumulation of the envelope waveshape is usually asynchronous with the tone source frequency, as shown in FIGS. 14(a) to (c). That is, by multiplying a tone source waveshape of FIG. 14(a) by such an envelope waveshape as shown in FIG. 14(b) whose level varies in a stairstep manner, such a multiplied tone source waveshape as shown in FIG. 14(c) is resulted. The multiplied waveshape is discontinuous at the level change points of the envelope waveshape except at the zero cross points thereof; this is the cause of noises. The general practice that has been adopted to make the level variations smooth for the reduction of such noises is to increase the number of words, i.e. the number of bits used, thereby to decrease the level variation at each step; but, it is obvious that this method introduces complexity in the accumulation processing.

Figure 13B:
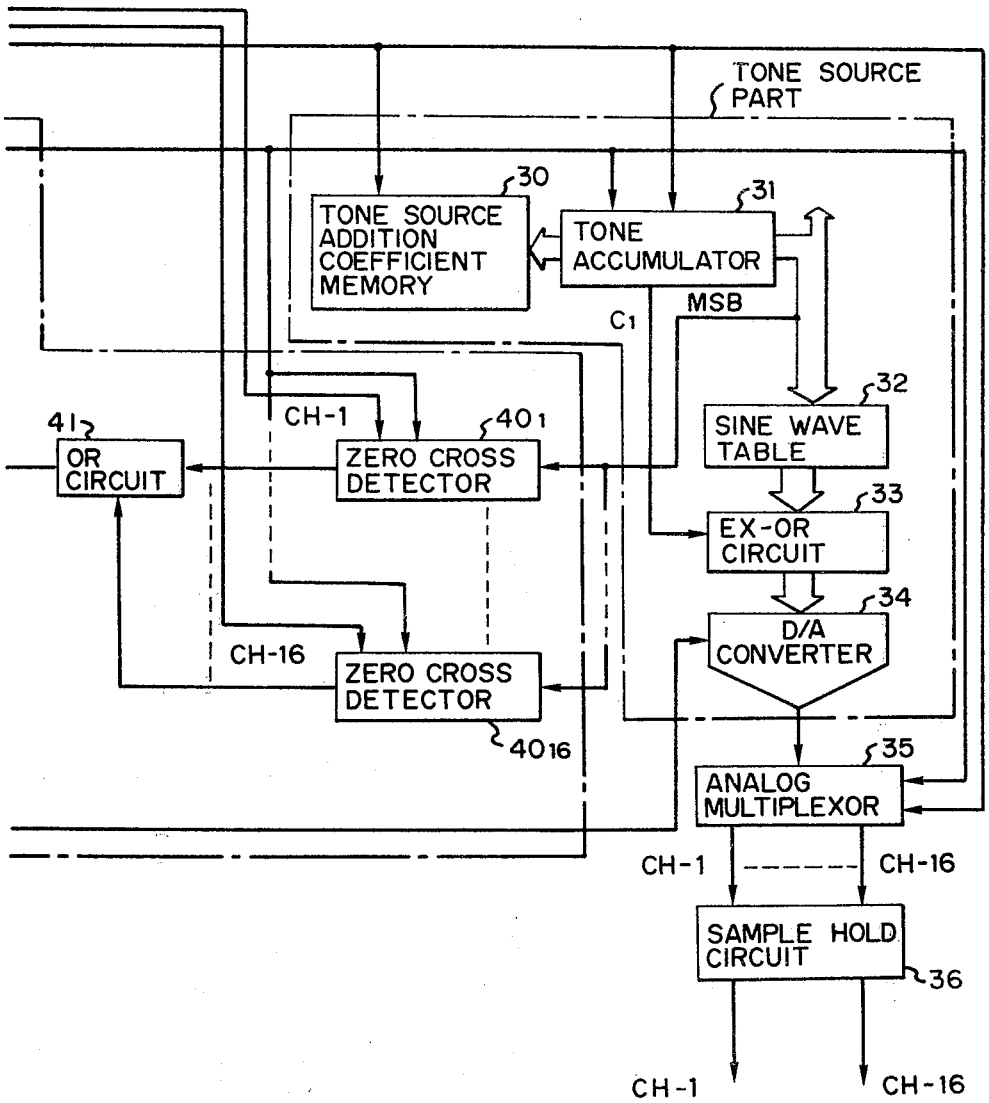
Figure 15:
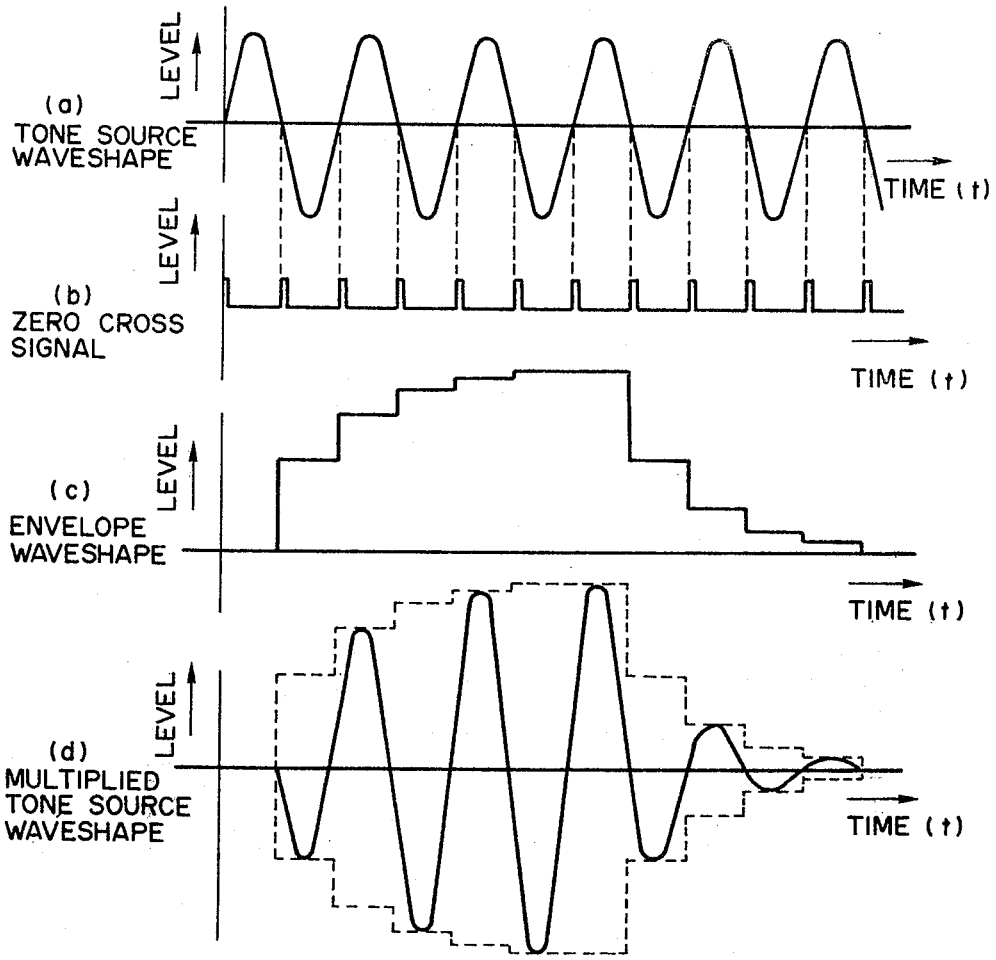
FIGS. 15(a) to (d) are diagrams explanatory of the principles of the embodiment shown in FIG. 13.

FIGS. 15(a) to (d) are explanatory of the general principles of the embodiment shown in FIG. 13. In the present embodiment, based on the fact that no discontinuations occur in the multiplied tone source waveshape at places where the zero cross points of the tone source waveshape and the level change points of the envelope waveshape coincide with each other, as seen from a comparison between FIGS. 14(a) to (c) and FIGS. 15(a) to (c), the multiplication is carried out with the zero cross points of the tone source waveshape and the level change points of the envelope waveshape synchronized with each other. That is, a zero cross signal of FIG. 15(b) is derived from the tone source signal of FIG. 15(a), and in synchronism with the zero cross signal, the coefficients relating to the envelope time are read from the envelope memory and accumulated by the accumulator to obtain such an envelope waveshape as depicted in FIG. 15(c) which has attack, hold and decay (or attack and decay). By multiplication of the tone source waveshape of FIG. 15(a) and the envelope waveshape of FIG. 15(c), a waveshape of FIG. 15(d) is obtained; namely, a multiplied tone source waveshape is obtained which is free from such discontinuous points as in the waveshape of FIG. 14, and this waveshape does not produce any noises. In practice, however, the digital waveshape in the accumulator is represented by a word of ½ wavelength, and the next ½ wavelength is represented by inverting the sign bit, thereby to simplify the processing. With this method, in the latter, the level change point of the envelope waveshape may jump over the zero cross point of the tone source waveshape. For example, if ½ wavelength of a tone source sign table is 256 words and if the accumulation coefficient is 10, then the accumulated value outputs are 10, 20, 30, . . . , 250, 4, 14, 24, . . . , namely, the output varies from 250 to 4 at the point of inversion of the sign bit, and the multiplication takes place at a point 4 past the zero cross point. In other words, the level change point of the envelope waveshape deviates slightly from one of two zero cross points per wavelength, but it is evident that the noise generation is suppressed far more than in the case where the level change points of the envelope waveshape and the zero cross points of the tone source waveshape are not synchronized with each other.

The embodiment shown in FIG. 13 is based on the principles described above. The envelope part in FIG. 13 is similar in construction to that used in FIG. 10 or 3 but is arranged so that the envelope time T is synchronized with the cycle of the zero cross point of the tone waveshape of a tone source part by a suitable selection of the aforementioned attack/decay coefficient Aad. The tone source part is similar in construction to the envelope part. In synchronism wth the channel address from the address counter 20, a tone source coefficient is read from a tone source addition coefficient memory 30 to a tone accumulator 31 composed of an adder, a gate circuit, a register and a memory (RAM). The tone source addition coefficient is accumulated, and the accumulated output signal corresponding to the tone frequency is applied as an address to a 256-word sine-wave table 32 to read therefrom a half-wavelength sine wave. As is the case with the envelope, the read output is provided to an exclusive-OR circuit 33, wherein it is inverted by a carry signal C1′ of the accumulated output signal from the tone accumulator 31, thus providing a sine-wave tone source waveshape. The frequency f of this tome waveshape is given as follows:

$$f = \frac{\frac{C_L}{n} \times Tad}{N \times 2 \times Ws} \text{ (Hz)}$$

where $C_L$ is the clock frequency, n is the timing dividing frequency, Tad is the tone addition coefficient, N is the number of channels, and Ws is the number of words. Next, the envelope time T is given as follows:

$$T = \frac{N \times W \times Ws}{Aad \times \frac{C_L}{n} \times Tad} \text{ (sec.)}$$

If N = 16, W = 32 , Ws = 256 and n = 4, the envelope time T is given as follows:

$$T = \frac{131072}{Aad \times \frac{C_L}{4} \times Tad} \text{ (sec)}$$

In this case, if the tone source frequency f is predetermined to be 1 KHz, it follows that when Aad = 0.8, $$T = (32/2 \times 0.8 \times 10^3) = 20 \text{ (ms)}$$

and that when Aad = 3.2, $$T = (32/2 \times 3.2 \times 10^3) = 5 \text{ (ms)}$$

As described, the embodiment of FIG. 13 is arranged so that the envelope time T of the accumulator 11 of the envelope part may coincide with the cycle of the zero cross point of the tone source frequency. Then, in FIG. 13, the attack/decay coefficient is read in synchronism with the zero cross point using the coefficient gate 26 for the hold control. To this end, the most significant bit of the accumulated value output from the accumulator 31, corresponding to each channel, is applied to one of zero cross detectors $\mathbf{40}_1$ to $\mathbf{40}_{16}$ to derive therefrom a zero cross detection signal, which is provided as a coefficient read timing signal to the coefficient gate 26 via the OR circuit 41 and a gate 27 inserted in a control circuit of the gate 26. That is, at the moment of zero crossing of the tone source frequency, the coefficient gate 26 opens to pass on the coefficient to the accumulator 11. Consequently, the accumulator 11 performs the accumulation in synchronism with the zero crossing moment. By the accumulated value output, the envelope waveshape in analog form is outputted from the D-A converter 23 following the aforesaid procedure. The envelope waveshape is provided to a multiplying type D-A converter 34 of the tone source part, wherein it is multiplied by the sine-wave tone frequency in digital form and converted to an analog signal. Then, the analog data time-divided by an analog multiplexor 35 is assigned to each of the channels CH1 to CH16, and the analog data of 1/16 unit time is held by a sample hold circuit 36 and outputted therefrom. In this way, the envelope waveshape and the tone waveshape are multiplied, with the level change points of the former synchronism with the zero cross points of the latter, by which the principles described previously with respect to FIG. 15 can be carried into practice.

A description will be given, with reference to FIG. 16, of a specific example of the zero cross detector 40 in FIG. 13 in relation to a detailed circuit arrangement of the accumulator 11.

The accumulator 11 comprises an adder 51, a gate circuit 52, a register 53 and a memory (RAM) 54 connected in a loop. By the address signal from the address counter 20, an attack coefficient corresponding thereto is read from the attack/decay coefficient memory 13 to the adder 51. The output data of the adder 51 passes through the gate circuit 52 which is opened by the level "H" of the output O from the OR circuit 16, and circulates in the loop by controlling the register 53 and the RAM 54 by the timing clock pulses $\tau_2$ and $\tau_3$, thus performing the accumulation. The end of the attach computation can be detected by a carry of the signal C1 of the register 53. When the signal C1 corresponds to the attack signal A and is controlled by the envelope control circuit 17, decay is started immediately, as shown in FIG. 5. In contrast thereto, when the signal C1 corresponds to the attack signal B and is controlled by the envelope control circuit 18, the coefficient gate 26 is closed to temporarily provide the hold state, and then decay is started by the fall of the attack signal, as shown in FIG. 6. In either case, upon occurrence of the signal C1, the output P from the OR circuit 15 is provided to the attack/decay coefficient memory 13 to switch the attack coefficient to the decay one. At the same time, the output R of the signal C1 is supplied to the EX-OR circuit 22 to invert the output signal from the envelope waveshape table (ROM) 14, forming the decay waveshape. Upon completion of decay, a carry of the signal C2 of the register 53 occurs, and by the output O from the OR circuit 16, the accumulation is stopped. When the attack input is applied again in the course of attack or decay, resetting takes place, and the accumulator 11 is cleared, resuming the accumulation. Five high-order bits of the accumulation result, excepting the signals C1 and C2, are applied as an address corresponding to the thirty-two words to the envelope waveshape table (ROM) 14, the three low-order bits being discarded. The envelope waveshape data is provided to the EX-OR circuit 22, wherein it is inverted in the case of decay, as described previously, and the inverted output is converted by the D-A converter 23 to an analog quantity.

In FIG. 10, the accumulation is performed by the coefficients merely relating to the attack and the decay time asynchronously with the zero cross timing of the tone waveshape, whereas in FIG. 13, the accumulation of the coefficients is performed which is synchronized with the zero cross timing of the tone waveshape, and in order to achieve synchronization of the accumlation, the zero cross detection signal is applied from the zero cross detector 40 to the gate 26 to control it.

Figure 16:
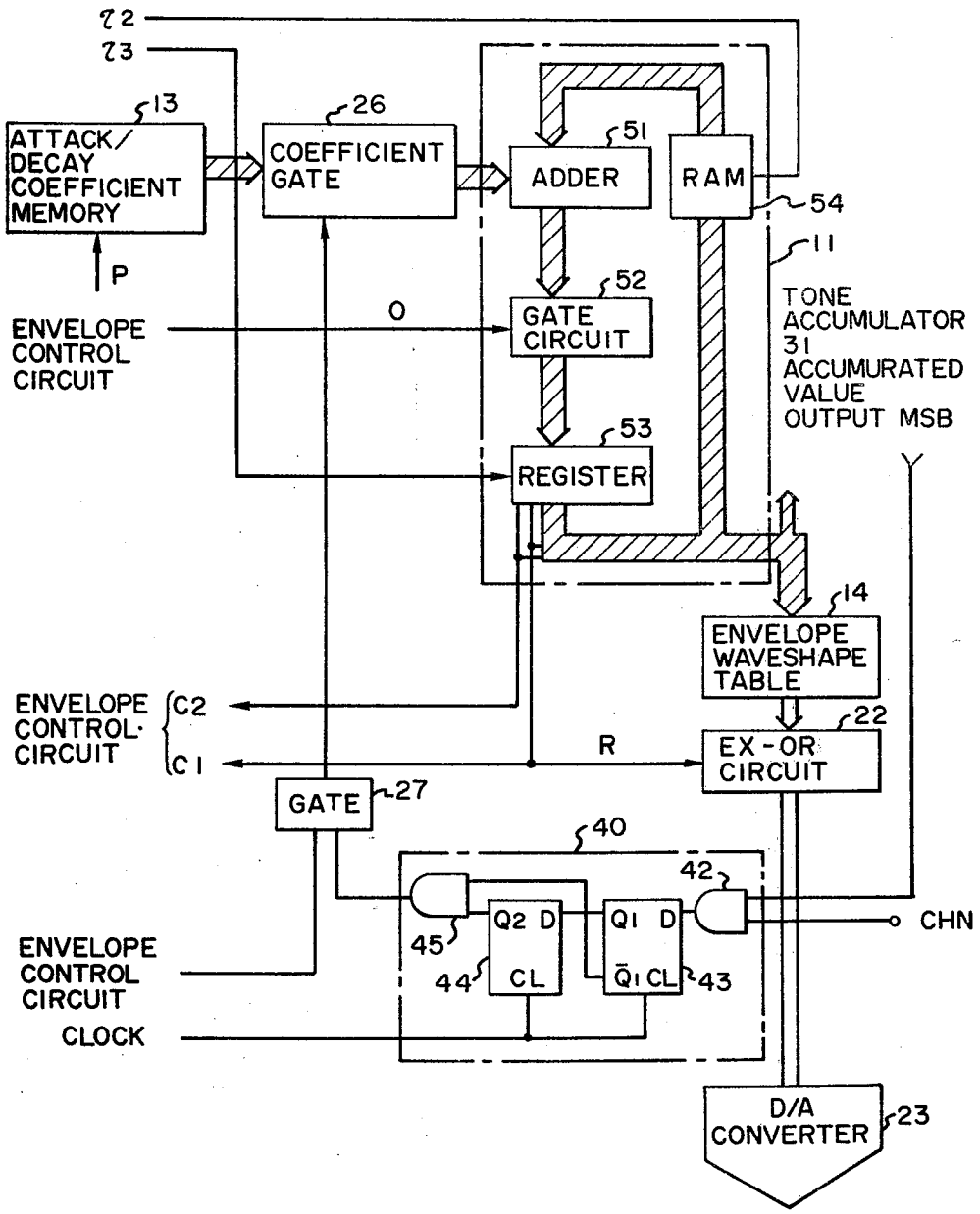
FIG. 16 is a diagram showing a specific example of a zero-cross detector utilized in FIG. 13.

As shown in FIGS. 13 and 16, the zero cross detector 40 takes out the most significant bit of the accumulated value output of the tone accumulator 31, and the channel synchronized output from the AND circuit 42 is applied to cascade-connected D flip-flops (DFF) 43 and 44 which are driven by the same clock pulse, and a $\overline{Q_1}$ output from the D flip-flop 43 and a $Q_2$ output from the D flip-flop 44 are provided via an AND circuit 45 and the gate 27 to the coefficient gate 26.

Figure 17:
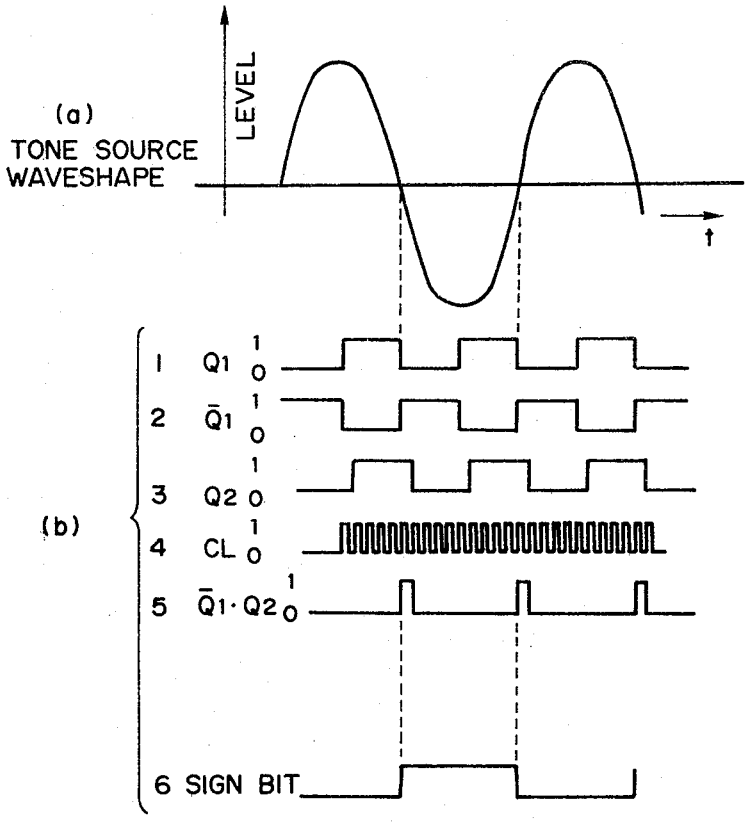
FIGS. 17(a) and (b) show operation waveforms of the zero cross detector of FIG. 16.

FIGS. 17(*a*) and (b)1 to (b)6 show operational waveforms of the abovesaid zero cross detector 40. That is, the timing frequency synchronized with the tone source waveshape of FIG. 17(*a*) is applied to the register 53 and the RAM 54 to carry out the accumulation. The output MSB from the tone accumulator 31 of the tone source part is supplied via the AND circuit 52 to a D terminal of the D flip-flop 43 to derive, as its $Q_1$ output, such a pulse waveform as shown in FIG. 17(*b*)1 whose cycle is synchronized with the zero cross point of the tone waveshape. The $Q_2$ output from the D flip-flop 44, shown in FIG. 17(*b*)3 is delayed behind the $Q_1$ output by one clock pulse of FIG. 17(*b*)4. Accordingly, when a $\overline{Q_1}$ output of FIG. 17(*b*)2 inverted from the $Q_1$ output and the $Q_2$ output are ANDed with each other in the AND circuit 45, there is produced such a zero cross detection signal as shown in FIG. 17(*b*)5 which is one clock pulse corresponding to each zero cross point of the tone waveshape. A sign bit of FIG. 17(*b*)6 indicates the polarity of the tone waveshape.

As described above, according to the present embodiment, in the system in which the envelope embodiment, in the system in which the envelope waveshape is obtained by accumulating the coefficient relating to the envelope time, the accumulation of the coefficient is carried out in synchronism with the zero cross point of the tone waveshape. Accordingly, in the case of multiplying the tone source waveshape and the envelope waveshape whose level varies in a stairstep manner, the zero cross point of the tone waveshape and the level change point of the envelope waveshape coincide with each other, so that no discontinuation is produced in the multiplied waveshape 1 therefore, noise generation can be reduced. The number of envelope quantization steps need not be increased for suppressing the noise generation but can be rather decreased, permitting simplification of the circuit arrangement.

Now, a description will be made of rhythm generation. The rhythm generator comprises a tone source part which yields a tone source frequency in accordance with the rhythm selected and an envelope part which provides the tone source frequency with an envelope waveshape. Tone source addition coefficients are each stored in a memory and accumulated to produce various tone waveshapes or envelope waveshapes, an the waveshapes are multiplied in a predetermined combination, thereby generating a desired rhythm.

Figure 18A:
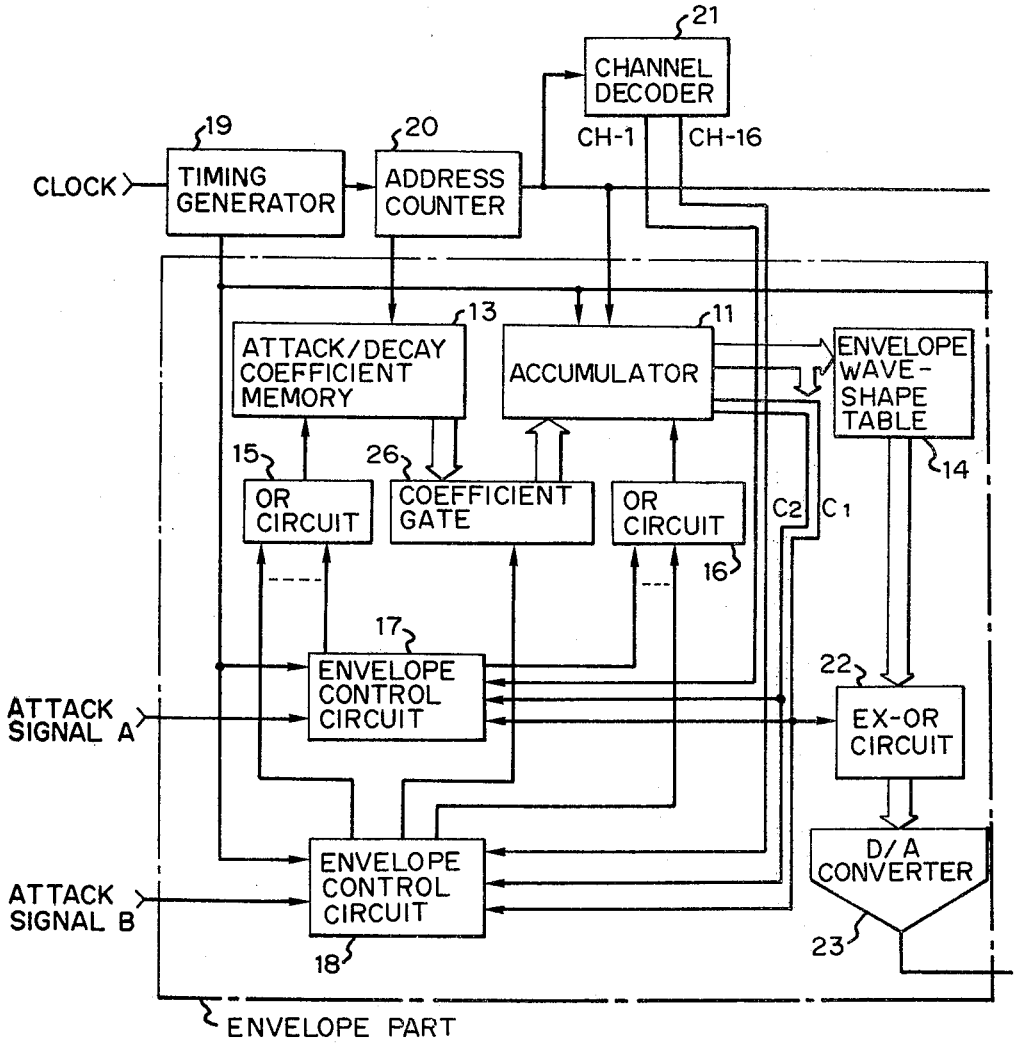
FIGS. 18A and B illustrate in block form an example of a rhythm generator according to this invention.
Figure 18B:
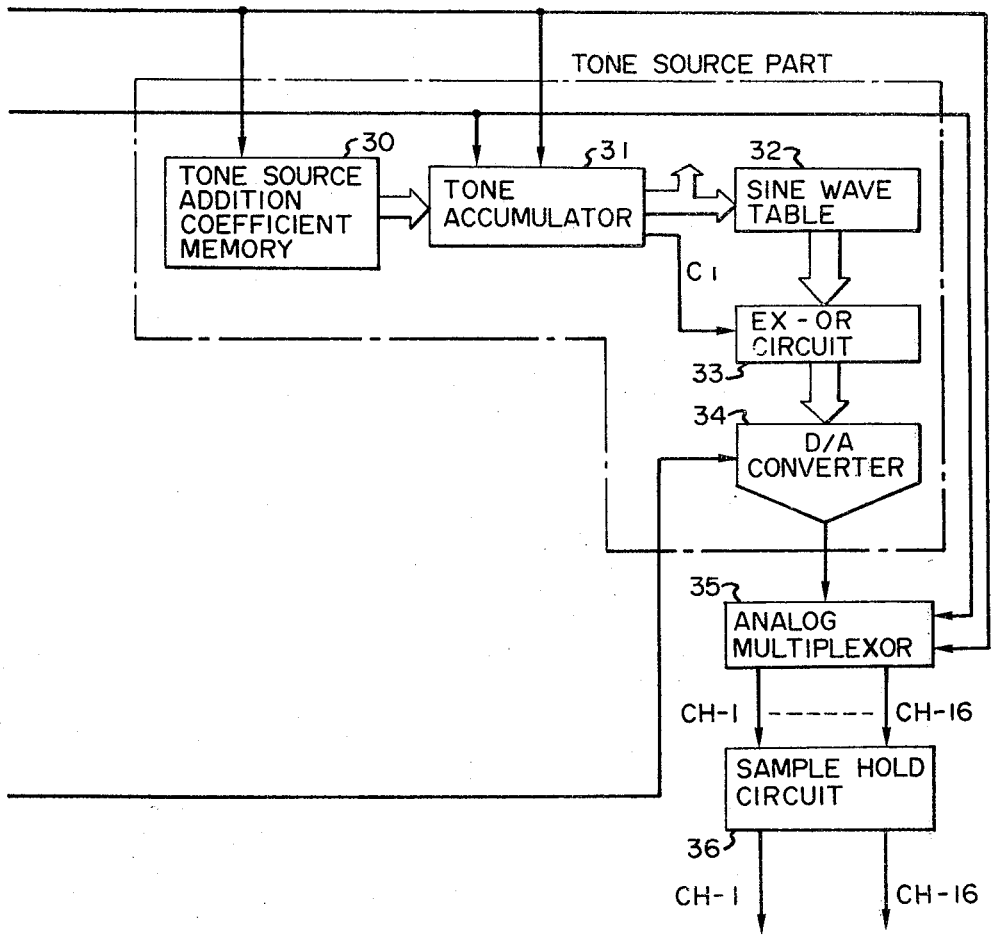

FIGS. 18A and 18B illustrate an example of the rhythm generator, in which the envelope part is identical in construction with that described previously with respect to FIG. 3 or 10.

The tone source part is similar in construction to the envelope part. In synchronism with the channel address from the address counter 20, the tone source addition coefficient is read from the tone source addition coefficient memory 30 to the tone accumulator 31 composed of an adder, a gate circuit, a register and a memory (RAM). The tone source addition coefficient is accumulated to yield an accumulated output signal corresponding to the tone source frequency, which is provided as an address to the 256-word sine-wave table 32 to read therefrom a sine wave of half wavelength. As is the case with the envelope, the sine-wave output is applied to the EX-OR circuit 33, wherein it is inverted by the carry signal C1′ of the accumulated output signal from the tone accumulator 31, providing a sine-wave tone waveshape in digital form. The frequency of this tone source waveshape is inputted to the multiplying type D-A converter 34, wherein it is converted to an analog signal multiplied by the envelope waveshape supplied from the D-A converter 23 of the envelope part. The analog signal thus obtained is applied to the analog multiplexor 35 to derive therefrom time-divided analog data, which is assigned to the respective channels CH1 to CH16, and then the analog data of 1/16 unit time is held in the sample hold circuit 36 and outputted therefrom.

For producing various rhythms by the rhythm generator of such construction, particular tone sources must be prepared for each rhythm. In the case of generating rhythms of rock and samba, if six kinds of tone sources, such as cymbal high-hat, snare drum tone, snare drum noise, bass drum and rimshot, are used for rock, and if seven kinds of tone sources, such as maraca, cowbell, high bongos, low bongos, high conga, low conga and bass drum, are used for samba, then twelve kinds of tone sources are required for the both rhythms; namely, only bass drum is common to rock and samba, and the other tone sources are not common to them. In the playing of rock, the tone sources for samba except bass drum are not required, so that the tone sources of maraca, cowbell, high bongo, low bongo, high conga and low conga need not be prepared. Conversely, in the playing of samba, the tone sources of cymbal, high-hat, snare drum tone, snare drum noise and rimshot need not be prepared.

Accordingly, if the rhythm generator of FIG. 18 is designed to provide addresses for the tone source addition coefficients and the attack/decay coefficients corresponding to the abovesaid six kinds of tone source in the playing of the rhythm of rock and addresses for such coefficients corresponding to the abovesaid seven kinds of tone sources in the case of samba, then the number of channels used could be reduced to seven.

Figure 19A:
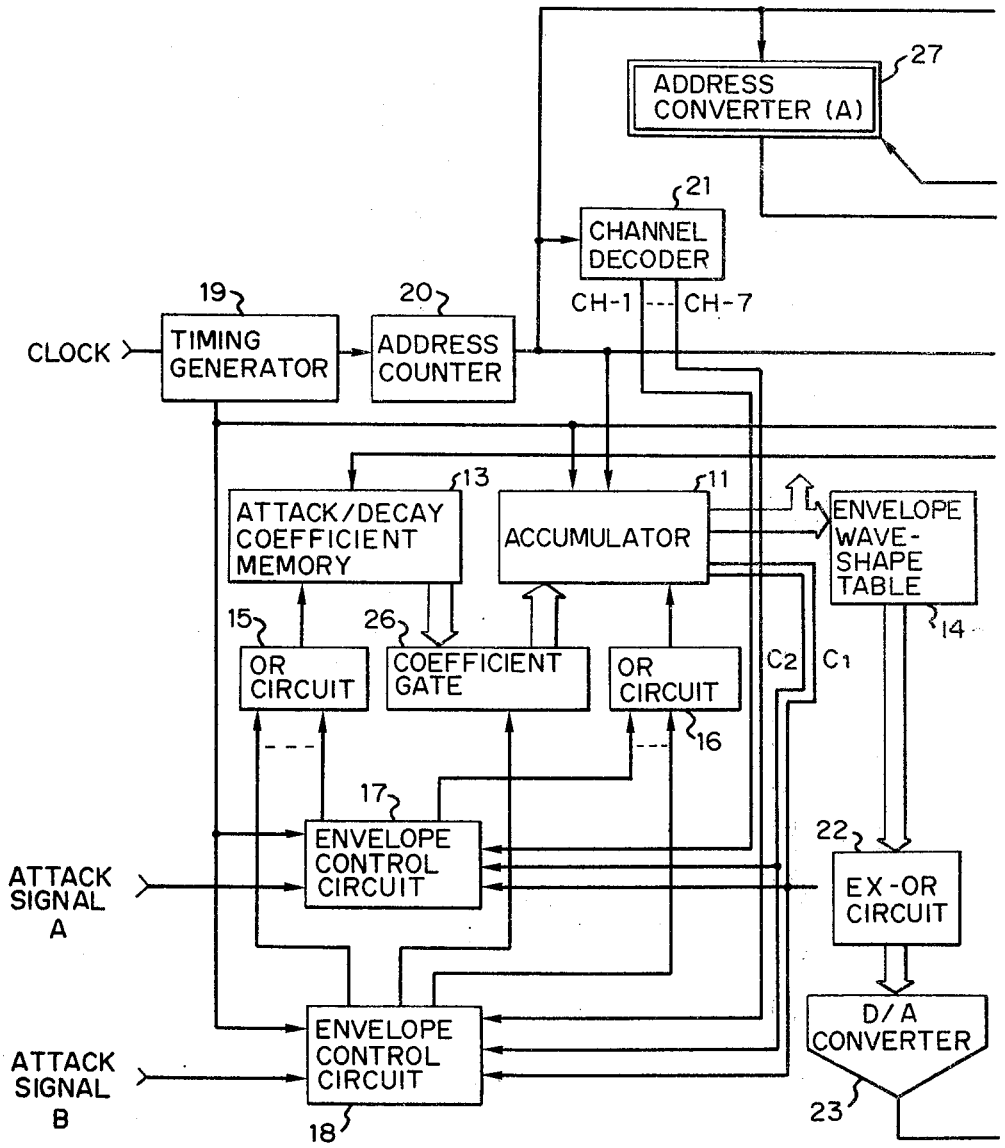
FIGS. 19A and B illustrate in block form another example of the rhythm generator.

For producing the rhythms of rock and samba by the rhythm generator of FIG. 18, twelve channels are needed respectively corresponding to the twelve tone sources, but in the case of an embodiment shown in FIGS. 19A and B, the number of channels used can be reduced to seven by the additional provision of such circuit elements as indicated by double-framed blocks for switching the addresses of the coefficients of the tone source waveshapes and the envelope waveshapes between rock and samba. That is to say, rock and samba are switched by a rhythm select switch 42 to each other, and an address converter (A)27 corresponding to the addresses for rock and an address converter (B)27 corresponding to the addresses for samba are switched by the a converter selector 29 to selectively apply respectively coefficient addresses to the tone source addition coefficient memory 30 and the attack/decay coefficient memory 13 to read them. In this way, the number of channels used can be reduced by half. In the case of rock and samba, a noise tone source may sometimes be selected other than the sine-wave tone source, as described in detail later; in order to cope with this, a tone/noise switching gate 37 is provided between the EX-OR circuit 33 and the multiplying type D-A converter 34. In dependence on whether the converter selector 29 is switched or not, information "1" or "0" of a noise channel memory (A)38 or (B)39 is read for input to the tone/noise switching gate 37, controlling an input thereto from a noise generator 50. An inverter 43 which applies the signal C1' to the tone/noise switching gate 37 after inverting it is provided to obtain the entire cycle from the sine-wave table 32 which has stored therein only the half cycle of the sine wave.

The operation of the above arrangement will be described concretely in connection with actual tone sources for rock and samba. Assume that channels are assigned to the tone sources for rock samba, as shown in Table 3. As shown, the tone source of bass drum is used in common to the both rhythms in channel 5.

TABLE 3

| Channel | Tone source (rock) | Tone source (samba) |
|---|---|---|
| CH-1 | cymbal | maraca |
| CH-2 | high-hat | cowbell |
| CH-3 | snare tone | high bongo |
| CH-4 | snare noise | low bongo |
| CH-5 | bass drum | bass drum |
| CH-6 | rimshot | high conga |
| CH-7 | | low conga |

Table 4 shows the tone sources corresponding to respective addresses of the tone source addition coefficient memory 30 and the attack/decay coefficient memory 13 (the attack and decay coefficients being shown separately). In Table 4, HEX indicates hexadecimal numbers.

TABLE 4

| Tone source | Tone source addition coefficient memory address | Attack coefficient memory address | Decay coefficient memory address |
|---|---|---|---|
| cymbal | 0 | 0 | 16 HEX (10) |
| high-hat | 1 | 1 | 17 (11) |
| snare tone | 2 | 2 | 18 (12) |
| snare noise | 3 | 3 | 19 (13) |
| bass drum | 4 | 4 | 20 (14) |
| rimshot | 5 | 5 | 21 (15) |
| maraca | 6 | 6 | 22 (16) |
| cowbell | 7 | 7 | 23 (17) |
| high bongo | 8 | 8 | 24 (18) |
| low bongo | 9 | 9 | 25 (19) |
| high conga | 10 HEX (A) | 10 HEX (1) | 26 (1A) |
| low conga | 11 (B) | 11 (B) | 27 (1B) |
| non-tone source | 12 (C) | 12 (C) | |

By the channel decoder 21, a signal for designating any one of the channels CH1 to CH7 is provided to the envelope control circuit 17 or 18, and an address signal corresponding to the attack signal is applied via the OR circuit 15 to the attack/decay coefficient memory 13. In the meantime, the address converter (A)27 or (B)28 is selected to provide therefrom coefficient addresses to the attack/decay coefficient memory 13 and the tone source addition coefficient memory 30, reading therefrom the coefficient data corresponding to the addresses shown in Table 4 to achieve channel assignment.

As shown in Table 3, the seven channels CH1 to CH7 are used by switching the tone sources assigned to the respective channels by the address converters (A)27 and (B)28. During the playing of rock, the address converter (A)27 is used to assign the channels and the tone sources, as shown in Table 5. In Table 5, since there is no tone source in an address 6, an address 12 of an addition coefficient "0" is selected in the address converter (A)27.

TABLE 5

| Channel | Converter A address | Tone sources for rock | Converter A memory code, binary MSB LSB | Decimal code |
|---|---|---|---|---|
| CH-1 | 0 | cymbal | 0 0 0 0 | 0 |
| CH-2 | 1 | high-hat | 0 0 0 1 | 1 |
| CH-3 | 2 | snare tone | 0 0 1 0 | 2 |
| CH-4 | 3 | snare noise | 0 0 1 1 | 3 |
| CH-5 | 4 | bass drum | 0 1 0 0 | 4 |
| CH-6 | 5 | rimshot | 0 1 0 1 | 5 |
| CH-7 | 6 | | 1 1 0 0 | 12 |

In the rhythm of samba, the address converter (B)28 is used to assign the channels to the tone sources, as shown in Table 6. In Table 6, the tone source of bass drum in address 6 is common to the both rhythms.

TABLE 6

| Channel | Converter B address | Tone sources for samba | Converter B memory code HSB LSB | Decimal code |
|---|---|---|---|---|
| CH-1 | 0 | maraca | 0 1 1 0 | 6 |

TABLE 6-continued

| Channel | Converter B address | Tone sources for samba | Converter B memory code HSB LSB | Decimal code |
|---|---|---|---|---|
| CH-2 | 1 | cowbell | 0 1 1 1 | 7 |
| CH-3 | 2 | high bongo | 1 0 0 0 | 8 |
| CH-4 | 3 | high bongo | 1 0 0 1 | 9 |
| CH-5 | 4 | high conga | 1 0 1 0 | 10 |
| CH-6 | 5 | low conga | 1 0 1 1 | 11 |
| CH-7 | 6 | bass drum | 0 1 0 0 | 4 |

Figure 20:
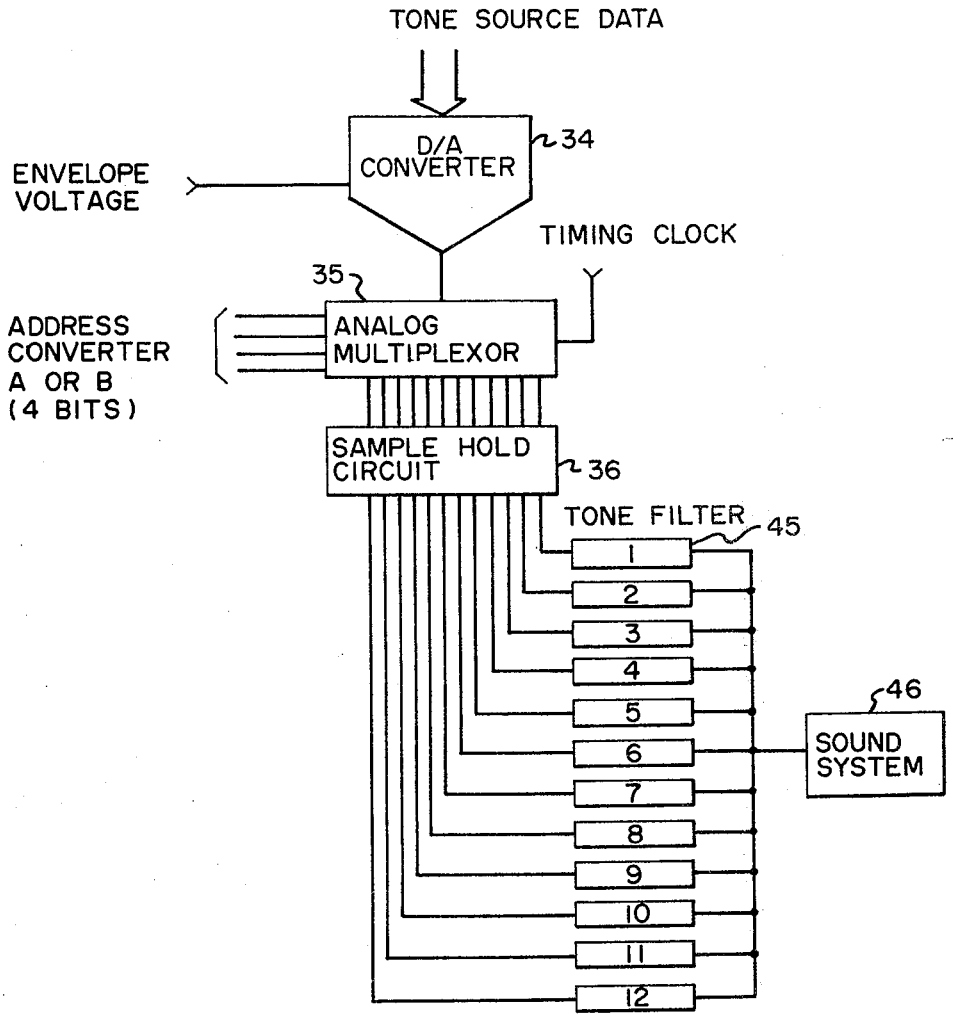
FIG. 20 is a detailed diagram explanatory of the output part of the rhythm generator depicted in FIG. 19.

The 4-bit information in the memories of the address converters (A)27 and (B)28, shown in Tables 5 and 6, is applied to the attack/decay coefficient memory 13 and the tone source addition coefficient memory 30 to read therefrom the corresponding coefficient data and, at the same time, is applied to the analog multiplexor 35. That is, as shown in detail in FIG. 20, in the analog multiplexor 35 the time-divided output from the tone source D-A converter 35 is assigned to twelve lines and held by the sample hold circuit 36, thereafter being respectively provided via tone filters 45 to a sound system 46.

Since the tone sources of cymbal, high-hat snare noise and maraca are generated by the noise source, the noise channel memories (A)38 and 39 are selectively switched by the tone/noise switching gate 37. The contents of the memories are shown in Table 7.

TABLE 7

| Address | Memory (A) (rock) data | Memory (A) (rock) tone source | Memory (B) (samba) data | Memory (B) (samba) tone source |
|---|---|---|---|---|
| 0 | | | | |
| 1 | 1 | cymbal | 1 | maraca |
| 2 | 1 | high-hat | 0 | cowbell |
| 3 | 0 | snare tone | 0 | high bongo |
| 4 | 1 | snare noise | 0 | low bongo |
| 5 | 0 | bass drum | 0 | high conga |
| 6 | 0 | rimshot | 0 | low conga |
| 7 | 0 | | 0 | bass drum |

As shown in Table 7, the output data is represented by one bit, and "I" and "0" select the noise and the tone, respectively. For example, in the case of rock, when addressing the channels 1, 2 and 4, a signal "1" is outputted to change over the tone/noise switching gate 37 to pass therethrough the output from the noise generator 50.

As described above, in an electronic musical instrument of the type employing a rhythm generator which produces a plurality of tones by using tone source addition coefficients and attack/decay coefficients, the plurality of tones are assigned to a small number of sets of tone sources and selectively switched, by which the number of tones used can be increased without the necessity of increasing the number of channels used. Accordingly, the arrangement relating to each channel is simplified; hence, the electronic musical instrument can be made lightweight and inexpensive.

Figure 19B:
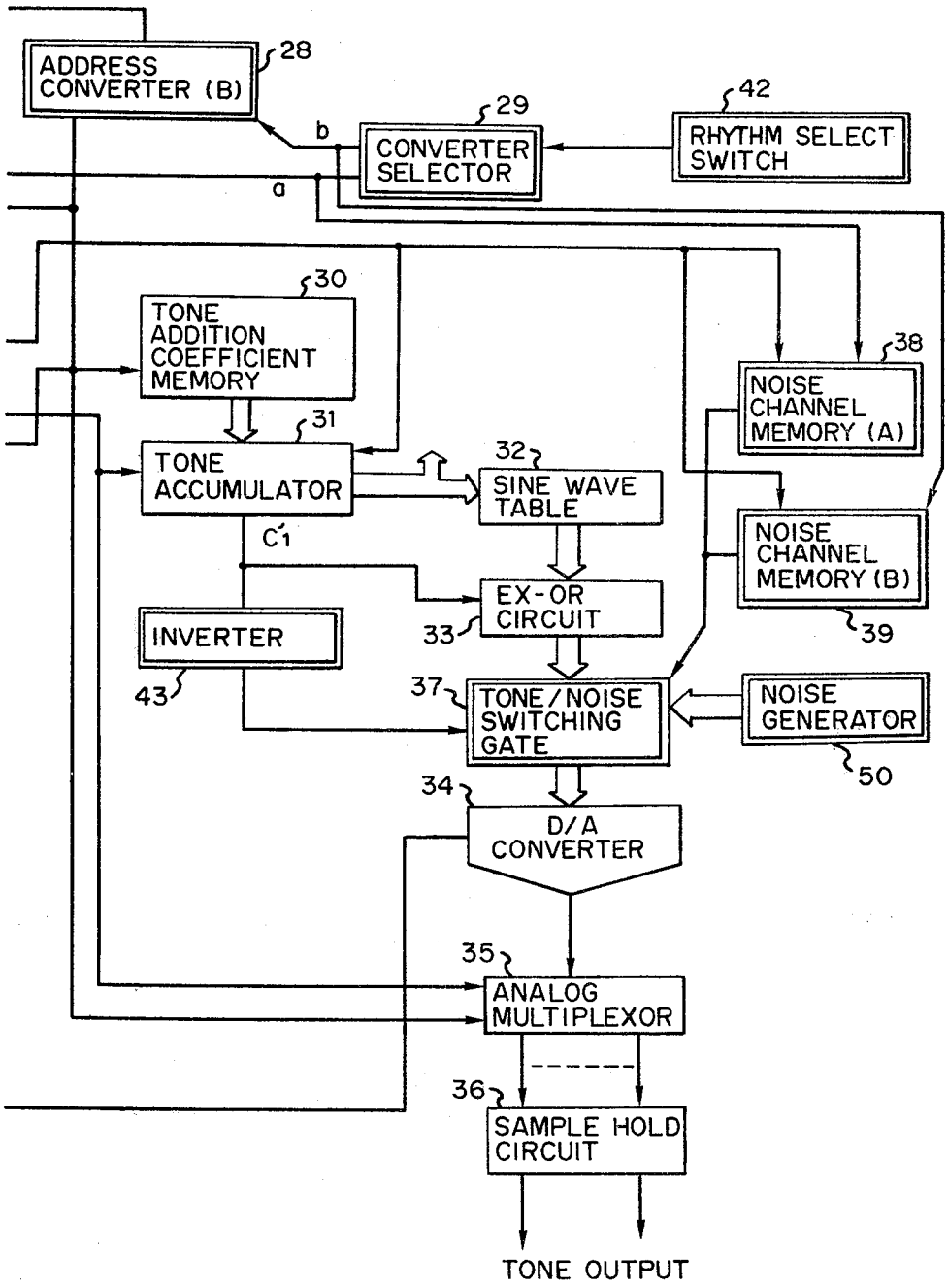
Figure 21A:
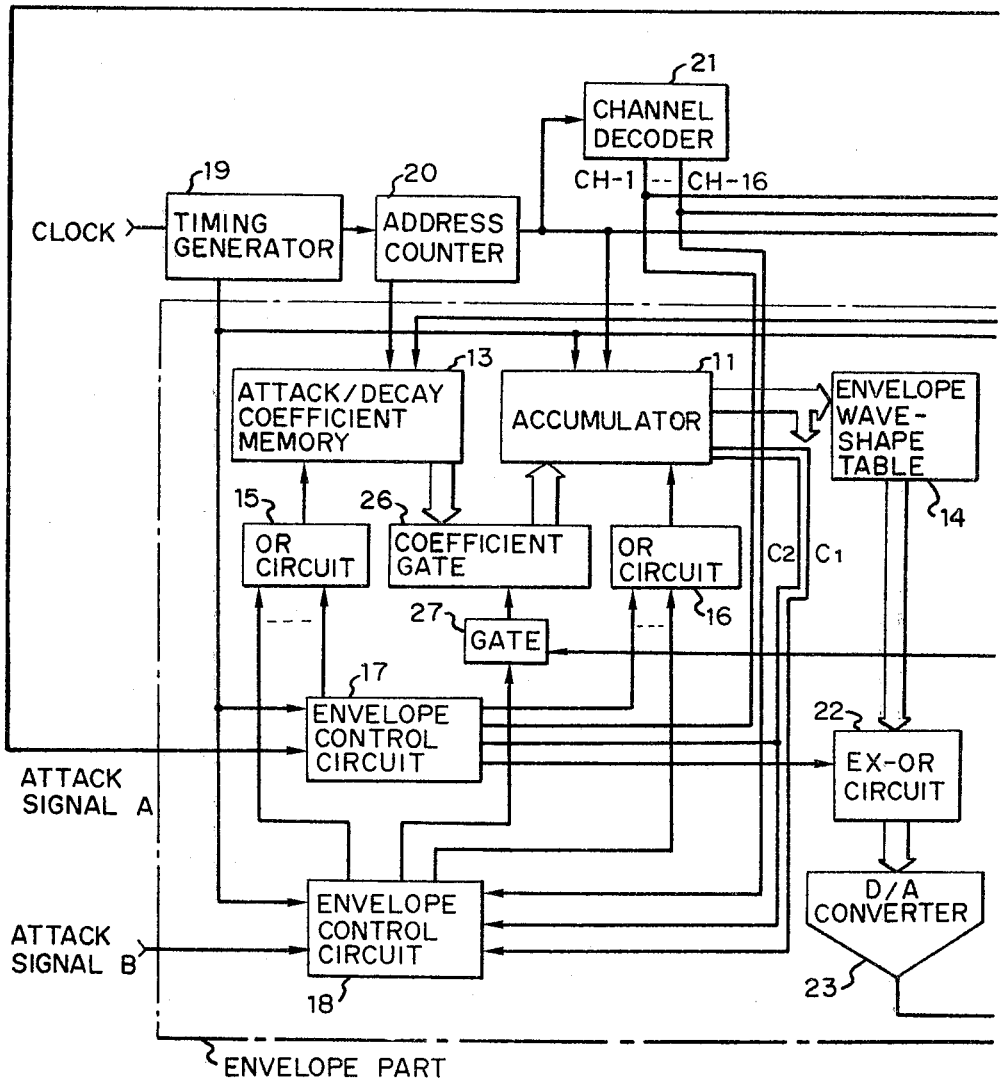
FIGS. 21A and B illustrate in block form still another example of the rhythm generator.

FIGS. 21A and B illustrate another embodiment of the rhythm generator of the present invention. In the rhythm generator of FIG. 19, the number of channels used can be reduced by switching the six kinds of tones for rock and seven kinds of tones for samba to each other, with one of the tones common to the both rhythms. It has been found that, in the above embodiment, a plurality of tones can be accommodated in one channel by a method of switching bars in one channel or separated parts in a bar. The rhythm generator of FIG. 21 is arranged to employ such a method.

Figure 21B:
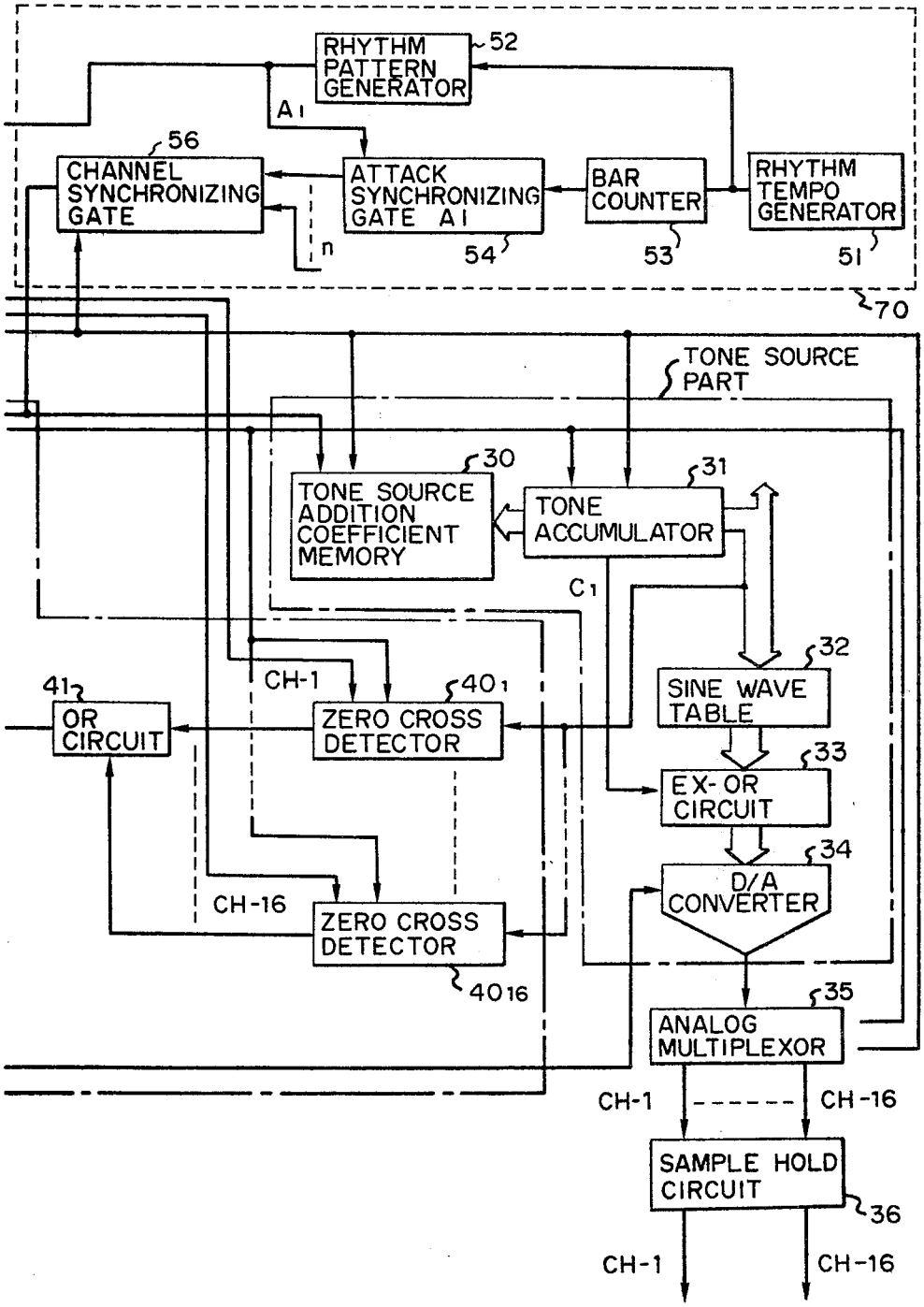

The embodiment of FIG. 21 differs from the embodiment of FIG. 18 in that there is provided means which is supplied with the output from the address counter 20 to change over the attack/decay coefficient memory 13 and the tone source addition coefficient memory 30 by each bar or separated part thereof. That is, a clock from a rhythm tempo generator 51 is applied to a bar counter 53 to count the number of beats and, at the same time, is provided to a rhythm pattern generator 52 to detect the position of a rhythm pattern. Attack signals $A_1$ which are outputted from the bar counter 53 and the rhythm pattern generator 52 are provided to attack synchronizing gates ($A_1$)54, wherein they are synchronized with each other, and these outputs are applied to a channel synchronizing gate 56 to obtain time synchronization. The output from the gate 56 is inputted to the attack/decay coefficient memory 13 and the tone source addition coefficient memory 30 at addresses described later. By this address control, the coefficient values of the coefficient memories 13 and 30 are read therefrom alternately for each bar or separated part thereof, by which different tones are generated in one channel. It is preferred that the tones accommodated in the same channel are those in the same sound range so that they can be subjected to common subsequent processing.

FIG. 22 shows in detail the principal part of the embodiment of FIG. 21, and FIGS. 23(*a*) to (*f*) are timing charts explanatory of its operation. A description will be given, with reference to FIG. 23, of the principal part depicted in FIG. 22.

In FIG. 22, the output a from the rhythm tempo generator 51, shown in FIG. 23(*a*), is provided to the bar counter 53, wherein the number of beats is counted to produce such an output c as shown in FIG. 23(*b*). The rhythm pattern generator 52 yields such an output b as shown in FIG. 23(*c*) which corresponds to the attack signal $A_1$. The output b from the rhythm pattern generator 52 is applied to one input of each of AND gates $54_1$ and $54_2$ of the synchronizing gate 54, and the output c from the bar counter 53 and its inverted signal are applied to the other inputs of the AND gates $54_1$ and $54_2$, by which the attack signals $A_1$ and $A_2$ are synchronized with each other. The AND gates $54_1$ and $54_2$ provide such outputs d and e as shown in FIG. 23(*d*) and (*e*), which are supplied to S and R terminals of an RS flip-flop $54_3$. Its Q output f shown in FIG. 23(*f*) is applied to the channel synchronizing gate 56 to achieve time synchronization by a channel time-division signal from the address counter 20. The output g from the channel synchronizing gate 56 is supplied to the attack/decay coefficient memory 13 and the tone source addition coefficient memory 30.

Figure 24:
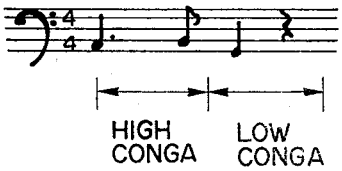
FIG. 24 shows one part of music which is applied to the example shown in FIGS. 21 and 22.

For example, in the case of where the bar is separated to include high conga in the first half and low conga in the second half, as shown in FIG. 24, when the bar counter 53 has counted the first two beats, its state is altered to change the respective memory coefficients, generating the tone of low conga.

Figure 25:
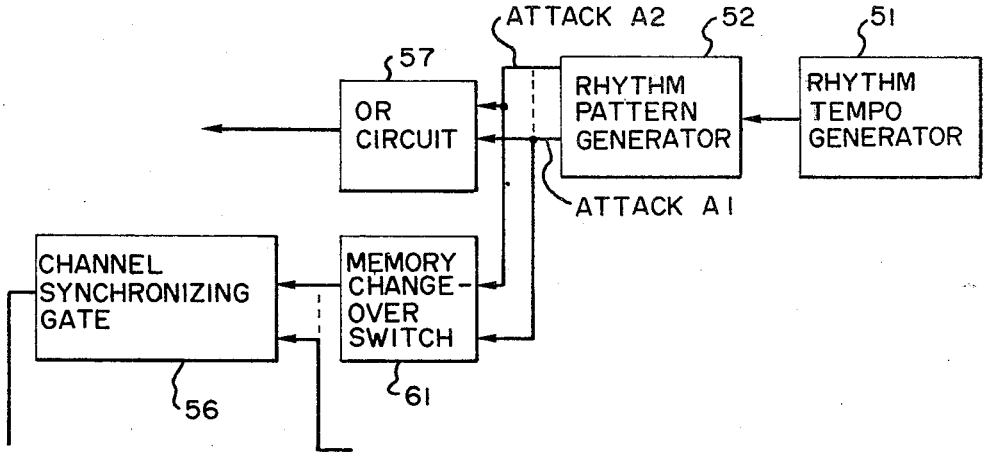
FIG. 25 is a block diagram illustrating the arrangement of another example of the broken line block 70 used in FIG. 21.

FIG. 25 shows one part (a broken line block 70 in FIG. 21) of the arrangement of another embodiment of the rhythm generator of this invention. In FIG. 25, the rhythm clock from the rhythm tempo generator 51 is applied to the rhythm pattern generator 52, from which the time-divided attack signals $A_1$ and $A_2$ are provided to a memory change-over switch 61 for each separated part of the bar, thereby to perform address switching. This enables omission of the bar counter 53 in FIG. 21, permitting simplification of the circuit arrangement. In this case, it is necessary to provide attack lines $A_1$ and $A_2$ in the rhythm pattern generator 52 for the channels.

Figure 26:
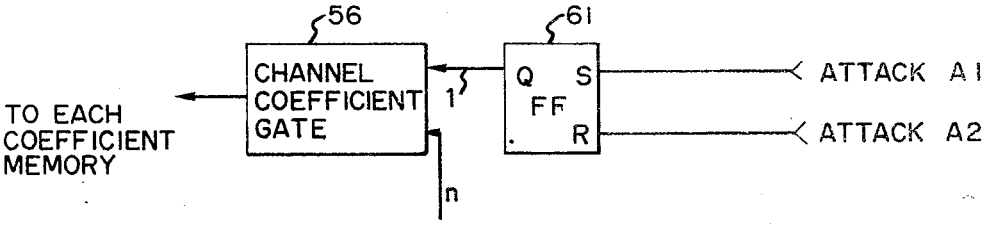
FIG. 26 shows an example employing an RS flip-flop as a memory change-over switch used in FIG. 25.
Figure 27:
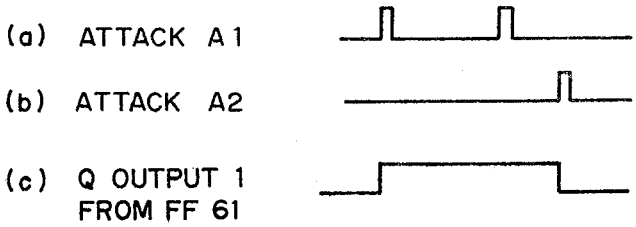
FIGS. 27(a) to (c) are explanatory of the operation of the example depicted in FIG. 26.

FIG. 26 illustrates a modified form of the circuit arrangement of FIG. 25 in which an RS flip-flop is used as the memory change-over switch 61. In this case, as shown in FIGS. 27(*a*) to (*c*), the operation correspond to the high conga and low conga in FIG. 24 to generate attack signals $A_1$ and $A_2$ depicted in FIGS. 27(*a*) and (*b*), by which the Q output is provided from the RS flip-flop 61 to the channel synchronizing gate 56.

As shown, by way of example, in Table 8, the addition coefficient of high conga by the attack signal $A_1$ and the addition coefficient of low conga by the attack signal $A_2$ are respectively prestored in addresses 0 and 16 of the attack/decay coefficient memory 13 and the tone source addition coefficient memory 30, and the address 0 or 16 is selected by the output from the channel synchronizing gate 51 in dependence on whether the output from the flip-flop 61 is "1" or "0".

TABLE 8

| Address | Tone source | Tone source addition coefficient (hexadecimal) | Attack/decay coefficient (hexadecimal) | |
|---|---|---|---|---|
| 0 | high conga | 83 | D2 | $\phi$5 |
| 1 | | | | |
| 2 | | | | |
| 3 | | | | |
| ∫ | | | | |
| 15 | | | | |
| 16 | low conga | 5D | D2 | $\phi$3 |
| 17 | | | | |

That is to say, in the case where a plurality of tones are accommodated in one channel, memory areas are selected which are different from those corresponding to the channels.

As described above, according to the present invention, there is provided address assignment means which selects rhythm patterns of predetermined tone sources in the same channel for each bar or separated part thereof, and by which the plurality of tones can be generated. Accordingly, the number of tones can be increased without the necessity of increasing the number of channels; hence, the present invention is of great utility for making the rhythm generator small and economical.

It will be apparent that many modifications and variations may be effected without departing from the scope of the novel concepts of this invention.

What is claimed is:

1. An electronic musical instrument comprising:

a rhythm pattern generator producing an external attack signal;

an attack/decay coefficient memory having stored therein coefficients relating to attack and decay times respectively for each of a plurality of external attack signals;

an accumulator for accumulating the coefficients at a constant speed to output the accumulated output signal in response to a clock and outputting attack and decay end signals;

an envelope control circuit for controlling the accumulated output signal from the accumulator by the external attack signal and the attack and decay end signals from the accumulator;

an envelope waveshape memory having stored therein envelope waveshapes, which are read by the accumulated output signal; and means for inverting the output signal from the envelope waveshape memory by the attack end signal from the accumulator.

2. An electronic musical instrument comprising:

a rhythm pattern generator producing an external attack signal;

an attack/decay coefficient memory having stored therein coefficients relating to attack and decay times respectively for each of a plurality of external attack signals;

an accumulator for accumulating the coefficients at a constant speed to output the accumulated output signal in response to a clock and outputting attack and decay end signals;

an envelope control circuit for controlling the accumulated output signal from the accumulator by the external attack signal and the attack and decay end signals from the accumulator;

accumulation stopping means for temporarily stopping the accumulation of the coefficients by the accumulator by means of a control signal from the envelope control circuit;

an envelope waveshape memory having stored therein envelope waveshapes, which are read by the accumulated output signal; and means for inverting the output signal from the envelope waveshape memory by the attack end signal from the accumulator.

3. An electronic musical instrument comprising:

first and second rhythm pattern generators respectively producing a first and second external attack signal;

an attack/decay coefficient memory having stored therein coefficients relating to attack and decay times respectively for each of a plurality of external attack signals;

an accumulator for accumulating the coefficients at a constant speed to output the accumulated output signal in response to a clock and outputting attack and decay signals;

first and second envelope control circuits for controlling the accumulated output signal from the accumulator by said first and second external attack signals and the attack and decay end signals respectively corresponding thereto;

accumulation stopping means for temporarily stopping the accumulation of the coefficients by the accumulator by means of a control signal from the second envelope control circuit;

an envelope waveshape memory having stored therein envelope waveshapes, which are read by the accumulated output signal; and means for inverting the output signal from the envelope waveshape memory by the attack end signal from the accumulator.

4. An electronic musical instrument comprising:

an attack/decay coefficient memory for storing coefficients relating to attack and decay times respectively for each of a plurality of time shared channels and outputting the coefficients on a time shared basis;

an accumulator for accumulating the coefficients at a constant speed;

an envelope waveshape memory addressed by the accumulated output signal from the accumulator to read out envelope waveshapes;

an envelope amplitude value memory for storing an envelope amplitude value for each of the time shared channels and outputting the amplitude value on a time shared basis; and a D-A converter for converting the output signal from the envelope waveshape memory to an analog quantity proportional to the output signal from the envelope amplitude value memory.

5. An electronic musical instrument comprising:

a musical tone generator for reading a musical tone from a musical waveshape memory by accumulating frequency information for determining a tone frequency;

an attack/decay coefficient memory having stored therein coefficients relating to attack and decay times respectively for each of a plurality of time shared channels;

an envelope generator for reading out an envelope waveshape from said coefficient memory by accumulating said coefficient at a constant speed for determining an envelope time;

a cross point detector for detecting the neighborhood of each point where a musical waveshape from the musical tone generator crosses a 0 and generating a signal; and control means for controlling, by each of said signals from the cross point detector, the accumulation of the coefficient by the envelope generator to read the envelope waveshape from the envelope memory for each crossing.

6. An electronic musical instrument comprising:

a musical tone generator for reading out a musical tone from a musical waveshape memory by accumulating frequency information stored in a tone source addition coefficient memory;

an attack/decay coefficient memory having stored therein coefficients relating to attack and decay times respectively for each of a plurality of time shared channels;

an envelope generator for reading out an envelope waveshape at a constant speed;

an address counter for performing address assignment so that the musical tone generator and the envelope generator may operate on a time shared basis; and a plurality of address converters for converting the output signal from the address counter to an address corresponding to a predetermined tone stored in the tone source addition coefficient memory and the attack/decay coefficient memory, the plurality of address converters being selectively designated by rhythm select means.

7. An electronic musical instrument comprising:

a musical tone generator for reading out a musical tone from a musical waveshape memory by accumulating frequency information stored in a tone source addition coefficient memory;

an attack/decay coefficient memory having stored therein coefficients relating to attack and decay times respectively for each of a plurality of time shared channels;

an envelope generator means for reading out an envelope waveshape from an envelope waveshape memory by accumulating a coefficient from said coefficient memory at a constant speed;

an address counter for performing address assignment so that the musical tone generator and the envelope generator may operate on a time shared basis;

a clock for producing beats of a rhythm pattern;

a bar counter for counting said beats and coordinating them into units of bars;

address assigning means supplied with the output from the address counter and responsive to the bar counter to select for each bar or separated part thereof a predetermined tone stored in the tone source addition coefficient memory and an envelope from said envelope generator means.

* * * * *